US009097411B2

(12) United States Patent
Guilmette

(10) Patent No.: US 9,097,411 B2
(45) Date of Patent: Aug. 4, 2015

(54) MULTIPLE-MODE INTEGRATED TRACK FIXTURE FOR HIGH EFFICIENCY TUBULAR LAMPS

(71) Applicant: Joseph Guilmette, North Hampton, NH (US)

(72) Inventor: Joseph Guilmette, North Hampton, NH (US)

( * ) Notice: Subject to any disclaimer, the term of this patent is extended or adjusted under 35 U.S.C. 154(b) by 248 days.

(21) Appl. No.: 13/743,669

(22) Filed: Jan. 17, 2013

(65) Prior Publication Data

US 2013/0182422 A1 Jul. 18, 2013

Related U.S. Application Data

(60) Provisional application No. 61/631,973, filed on Jan. 17, 2012.

(51) Int. Cl.

| | |
|---|---|
| ***F21V 21/00*** | (2006.01) |
| ***F21L 4/02*** | (2006.01) |
| ***F21S 2/00*** | (2006.01) |
| ***F21V 21/30*** | (2006.01) |
| ***F21V 21/34*** | (2006.01) |
| *F21V 7/00* | (2006.01) |
| *F21V 7/22* | (2006.01) |
| *F21V 15/01* | (2006.01) |
| *F21Y 101/02* | (2006.01) |
| *F21K 99/00* | (2010.01) |
| *F21Y 113/00* | (2006.01) |

(52) U.S. Cl.

CPC . *F21V 21/00* (2013.01); *F21L 4/02* (2013.01); *F21S 2/00* (2013.01); *F21V 21/30* (2013.01); *F21V 21/34* (2013.01); *F21K 9/17* (2013.01); *F21V 7/005* (2013.01); *F21V 7/22* (2013.01); *F21V 15/013* (2013.01); *F21Y 2101/02* (2013.01); *F21Y 2113/00* (2013.01)

(58) Field of Classification Search

CPC ..... F21V 21/00; F21V 7/005; F21V 21/34; F21V 2101/02; F21L 4/02; F21S 2/00

USPC ..... 362/217.05, 217.16, 217.17, 225, 184, 362/190, 219, 260

See application file for complete search history.

(56) References Cited

U.S. PATENT DOCUMENTS

| | | | | |
|---|---|---|---|---|
| 4,858,088 | A * | 8/1989 | Agabekov | 362/217.12 |
| 5,165,048 | A * | 11/1992 | Keller et al. | 320/113 |
| 6,361,186 | B1 * | 3/2002 | Slayden | 362/241 |
| 7,182,627 | B1 * | 2/2007 | Huang | 439/487 |
| 7,287,883 | B1 | 10/2007 | Plunk et al. | |
| D592,785 | S | 5/2009 | Bisberg et al. | |
| D632,418 | S | 2/2011 | Bisberg et al. | |
| 7,959,334 | B2 * | 6/2011 | Tsai et al. | 362/396 |
| 8,207,821 | B2 | 6/2012 | Roberge et al. | |
| 8,210,724 | B2 | 7/2012 | Ying | |
| 8,337,043 | B2 * | 12/2012 | Verfuerth et al. | 362/221 |

(Continued)

*Primary Examiner* — John A Ward

(74) *Attorney, Agent, or Firm* — McLane, Graf, Raulerson & Middleton, Professional Association

(57) ABSTRACT

A modular lighting system features a universal mounting method for lighting elements, such as LED lights, as well as various electrical devices, and is configurable in multiple modes of operation. In one aspect, LED strips are inserted into slots in the lower surface of the rail member. Another aspect allows operation with tube lamps, such LED tube lamps. In still another mode of operation, discrete electrical or electromechanical components may be employed, powered by electrical power available in the rail. In yet another more, an up and down, bidirectional lighting system is provided.

20 Claims, 29 Drawing Sheets

(56) References Cited

U.S. PATENT DOCUMENTS

| | | | | |
|---|---|---|---|---|
| 8,425,080 | B2 * | 4/2013 | Konaka | 362/249.02 |
| 8,439,517 | B2 * | 5/2013 | Welker | 362/217.11 |
| 8,789,966 | B2 * | 7/2014 | McCanless et al. | 362/218 |
| 8,807,784 | B2 * | 8/2014 | Marquardt et al. | 362/218 |
| 2006/0146531 | A1 * | 7/2006 | Reo et al. | 362/244 |
| 2009/0207602 | A1 * | 8/2009 | Reed et al. | 362/225 |
| 2010/0254146 | A1 | 10/2010 | McCanless | |
| 2011/0199005 | A1 * | 8/2011 | Bretschneider et al. | 315/152 |
| 2012/0155073 | A1 | 6/2012 | McCanless et al. | |

* cited by examiner

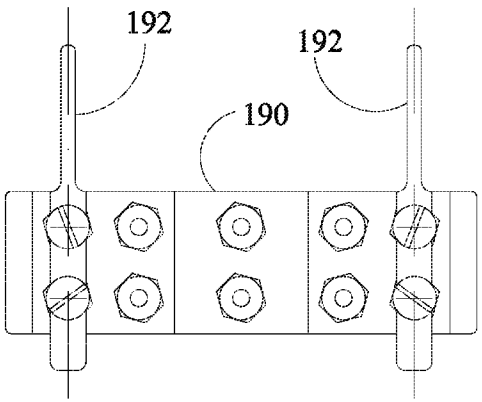
FIG. 15B
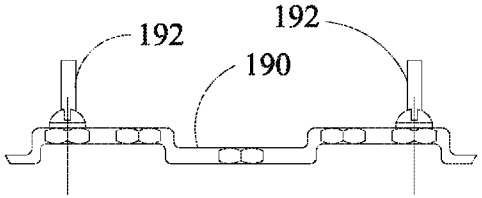
FIG. 15C
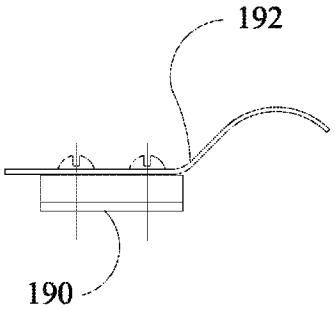
FIG 15. D

MULTIPLE-MODE INTEGRATED TRACK FIXTURE FOR HIGH EFFICIENCY TUBULAR LAMPS

CROSS-REFERENCE TO RELATED APPLICATION(S)

This application claims priority under 35 U.S.C. §119(e) of U.S. provisional application No. 61/631,973, filed Jan. 17, 2012. The aforementioned application is incorporated by reference in its entirety.

BACKGROUND

The present invention is generally directed to a modular lighting system and, more particularly, to a lighting system employing a multiple-mode, integrated track fixture. Although the present development will be show and described herein by way of reference to LED lighting elements, including flexible LED strips and/or for high efficiency tubular LED lamps, it will be recognized that the modular rail system herein may also be adapted for use with conventional fluorescent tubes.

A major effort in LED lighting is the development of replacement lamps for the fluorescent tube, which is in common use in industrial and commercial applications. An accepted direction of the technology is to directly replace the fluorescent lamp in its existing fixture with a mechanically equivalent LED equivalent tube which requires no modification of the mounting fixture. However, many applications including new construction require completely new lighting systems such as the ones described in this disclosure.

It has been determined that the LED requires less than 25% of the input power required by conventional non-fluorescent light sources and 50% less than fluorescent light sources. This reduced power requirement allows a significant increase in the number of lamps that can be accommodated on a single branch circuit. For example, assuming a power demand of 15 watts/lamp, as many as 100 lamps could be wired to a single 120V AC, 15 amp branch circuit.

Accordingly, the present disclosure contemplates a new and improved LED lighting system which can take advantage of such reduced power requirements.

SUMMARY

High bay installations frequently require a long string of fixtures wired to one parallel branch circuit. The present disclosure describes a system for connecting assemblies together thus creating a long linear array of fixtures using elongate beams or rails and connector sleeves. The initial hanging point is located at the end of the first assembly. A second hanging point may be used to support a single assembly or, in the event of multiple assemblies, the hanging point may be at the center of the subsequent connector sleeves. This hanging configuration may be repeated multiple times until reaching the last assembly. Assemblies are joined together using welded connections, lock pins or similar device, or a combination of welded joints and removable fasteners to link the assemblies to the connector sleeve. The last assembly may hang from a mounting point at the end its support beam.

Once the pre wired assemblies are located in the building, the only requirement for electrical connections is to plug the first assembly into a wall outlet and subsequent assemblies may be plugged into the preceding assembly's outlet at the junction box, up to the power limits of the electrical equipment.

One advantage of the mounting system herein is that each sub fixture can be independently mounted and connected. A continuous lighting array is not required and the sub fixtures may be substituted with other devices or left blank. These devices may be designed into a chassis that simulates the strip fixture thus can be integrated anywhere into the system thus providing a modular type installation. Some of the devices that may be mounted using the system herein include but are not limited to:

1. One or more spot or flood lights for emphasis at a particular location;
2. Sound system components (e.g., loudspeakers);
3. Security system components (motion detectors or cameras);
4. Safety system (fire detection equipment, carbon monoxide or other hazard detector equipment, alarms);
5. Accent lighting;
6. Thermal sensing devices for HVAC systems;
7. Computer network equipment such as a Wi-Fi router or extender, or the like.

If required, wiring between these devices is easily accomplished within the system using the existing wiring paths within the structures. All wiring between these devices can be completed internally from any point to another in the system, thus virtually eliminating external wiring and unsightly wires.

One advantage of the present invention resides in its ability to eliminate the need for on-site wiring for the various modes of operation.

Still further advantages and benefits of the present development will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for the purpose of illustrating preferred embodiments and are not to be construed as limiting the invention.

FIG. 7 is a cross-sectional view illustrated the manner of attaching a spotlight, flood light, accent light, or the like.

FIGS. 15B-15D are top, front, and side views, respectively, of the exemplary terminal block and brush connector system appearing in FIG. 15A.

DETAILED DESCRIPTION OF THE PREFERRED EMBODIMENTS

The present development takes advantage of the reduced power requirements by providing a method to engage and interconnect multiple LED lamp fixtures onto a track/rail beam with optional spacing between them. This track/rail beam and also is designed to function as a wiring troth and is dimensioned to accept commonly available electrical hardware such as junction boxes and outlets. This concept permits factory pre wiring prior to installation at the construction site thus enabling considerable cost savings when compared to conventional building wiring. The fixture assemblies are installed in the high bay building using chains or cables suspended from the roof structure at predetermined points. An alternate mounting method is presented which is especially suited for wood beam structures using swivel brackets.

For larger installations requiring a long string of lamps, a method of connecting track/rail beams using a connector sleeve permits connections using only quick release pins for fastening sections. This is especially useful for temporary lighting requirements since the sections are readily disassembled by removing the quick disconnect pins and sliding the sections apart. Electrical connections are conveniently made with receptacles and power cords provided with each assembly. The first assembly is connected to a switched outlet and subsequent assemblies connected to the one in front of it up to the safe limit of the electrical load.

The lighting system track/rail features a universal mounting method for various electrical devices resulting in multiple modes of operation. The most basic operational mode is the use of LED strips inserted into slots in the lower surface of the track/rail. A second operational mode is achieved with the use of LED tube fixtures while a third mode is realized which features a method of mounting discrete components into the system taking advantage of electrical power conveniently available in the rail. A fourth mode, bidirectional, shows the system configured to emit light both upward and downward simultaneously from separate light sources that can be independently controlled.

Figure 1A:
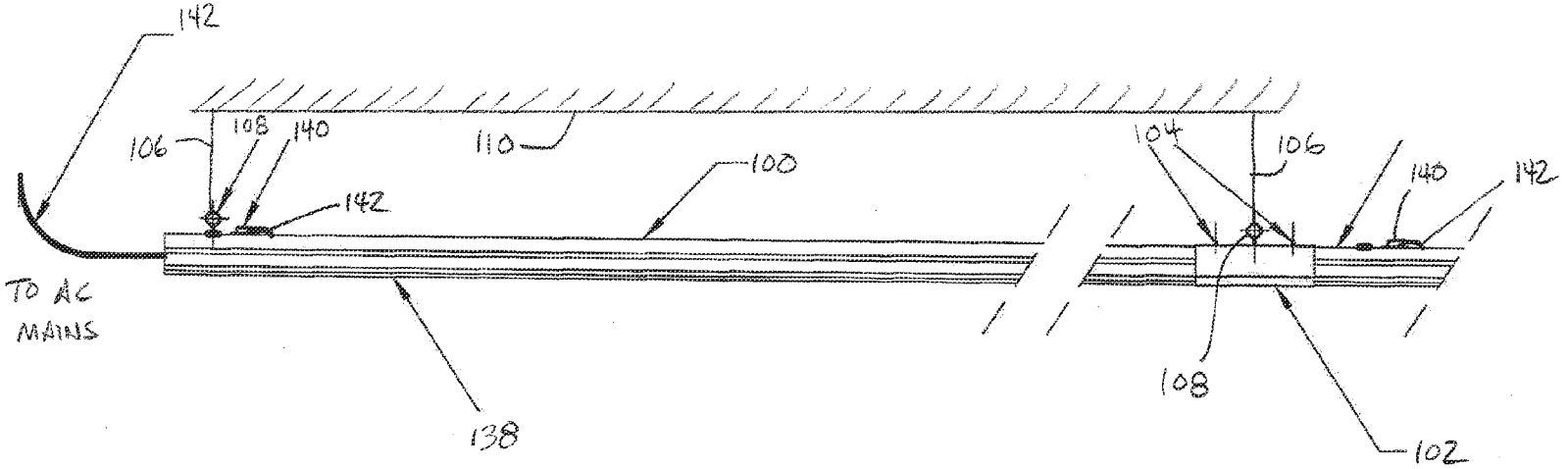
FIG. 1A is a side view of an exemplary light bar embodiment.
Figure 1B:
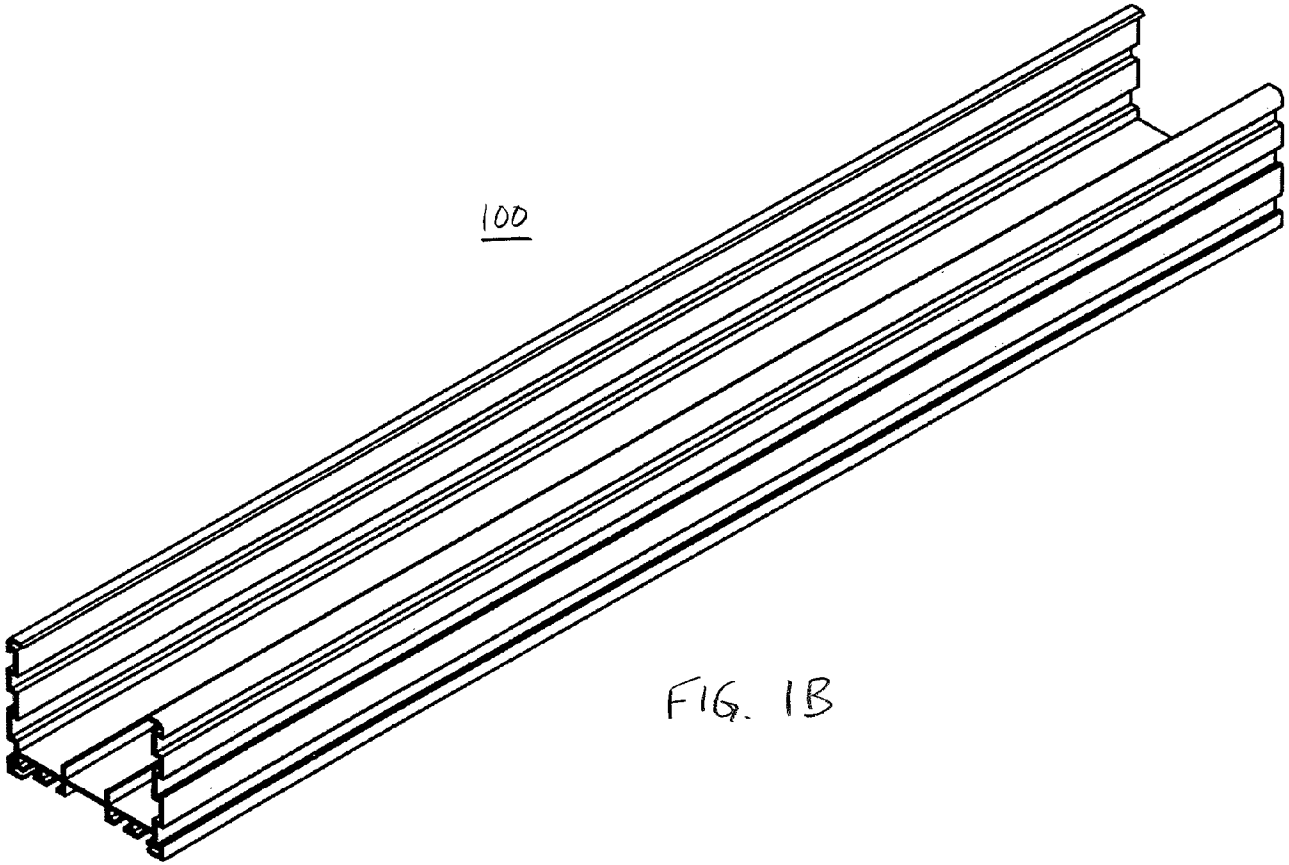
FIG. 1B is an isometric view of the main rail or beam appearing in FIG. 1A.
Figures 1C, 1D:
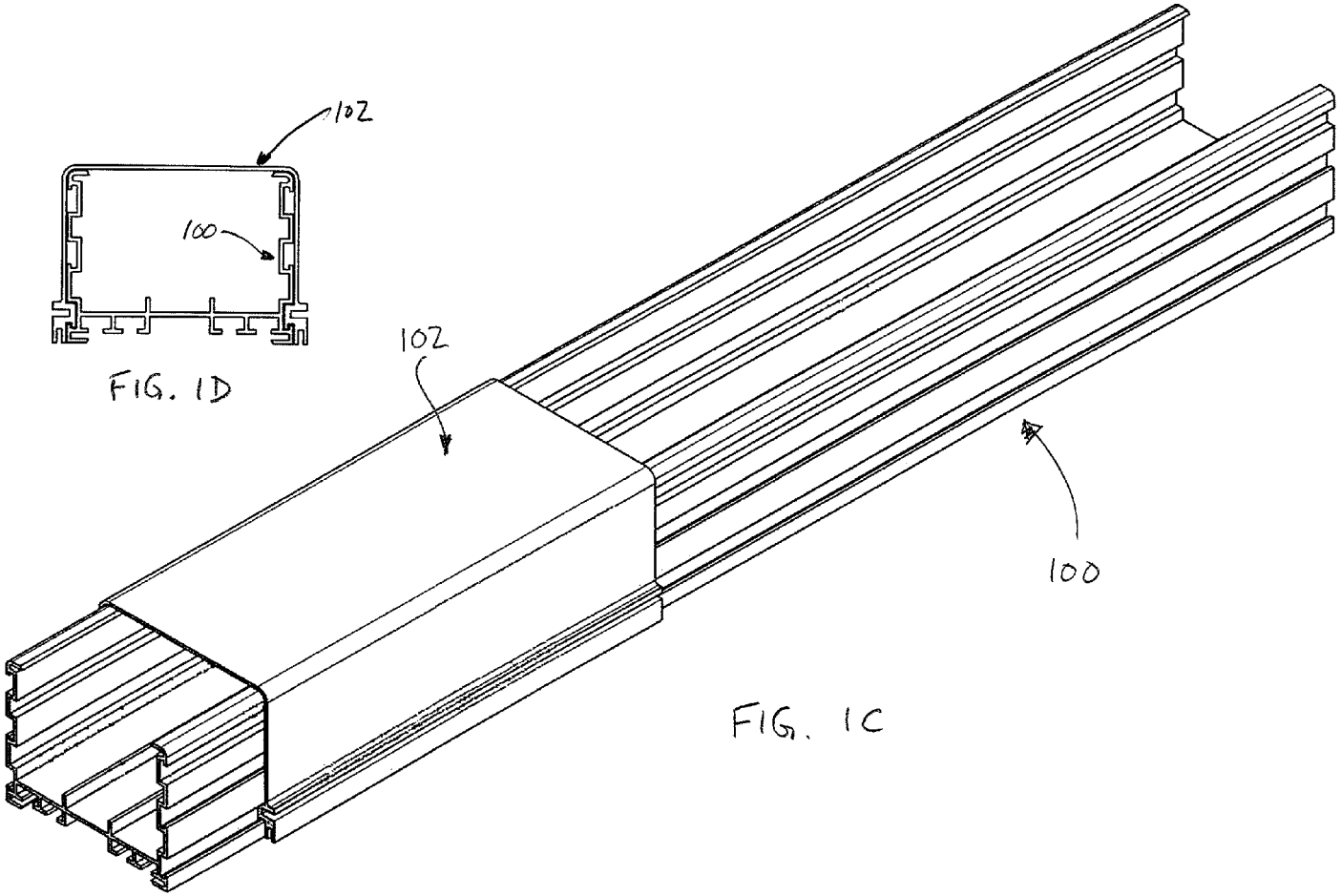
FIGS. 1C and 1D are isometric and cross-sectional views, respectively, of a rail and connector sleeve in accordance with an exemplary embodiment.
Figure 1E:
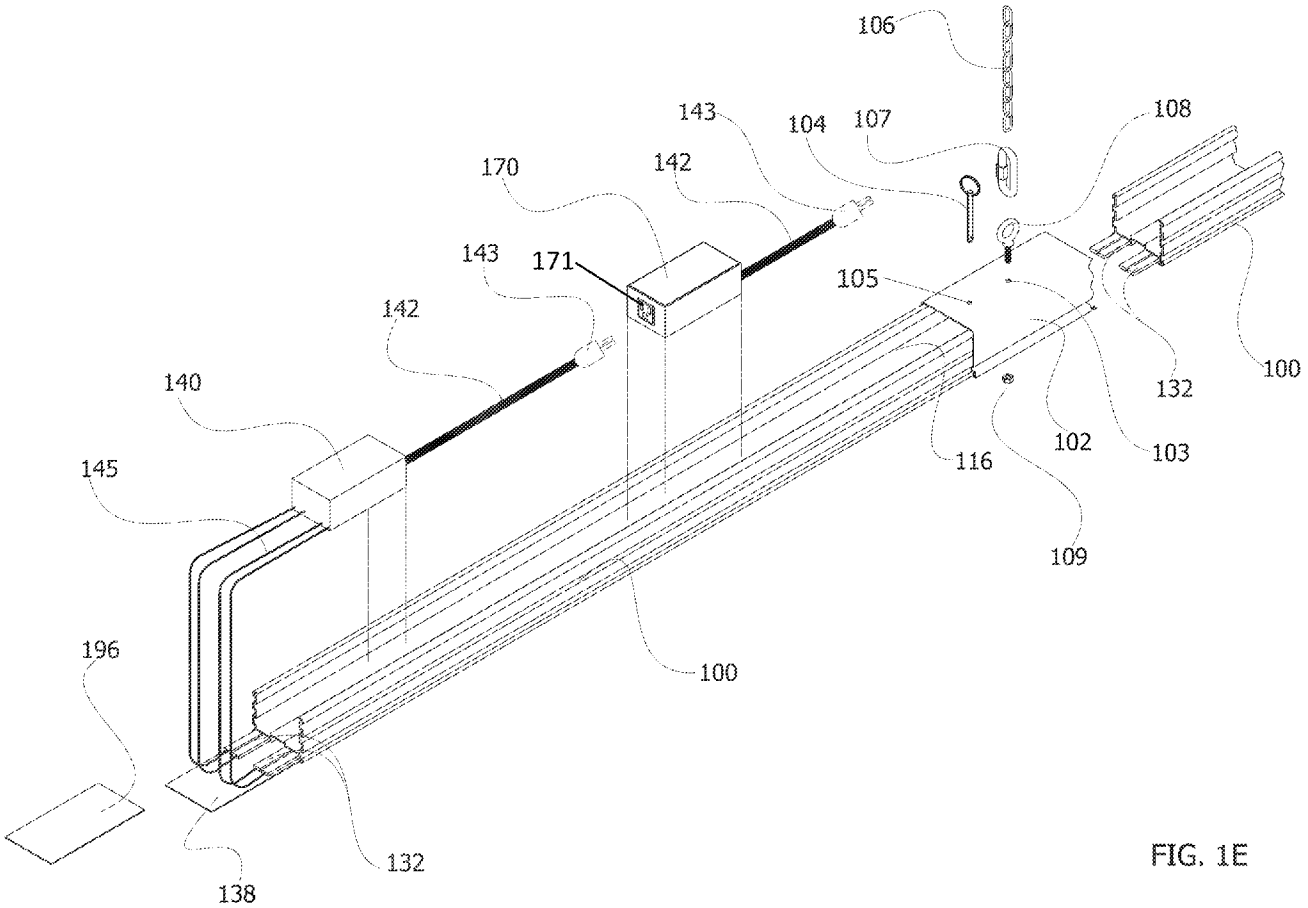
FIG. 1E is a partially exploded view of the embodiment appearing in FIG. 1A.

With reference to FIGS. 1A and 1E, there appears a basic layout of the multi light fixture herein in what is referred to herein as the light bar mode. The primary structural component is the track/rail beam 100, designed to accommodate all operational modes described in this disclosure. An isometric view of the beam 100 appears in FIG. 1B. A cross-sectional view of the beam 100 appears in FIG. 9.

Figure 9:
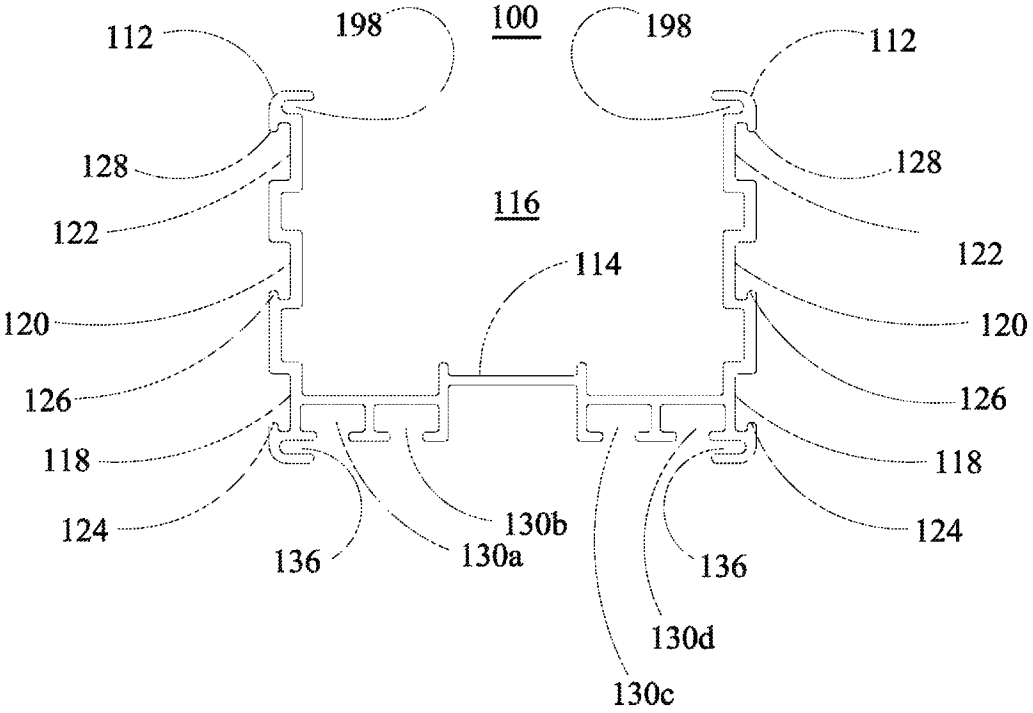
FIG. 9 is an enlarged cross-sectional view of an exemplary main rail member.

FIG. 9 reveals a cross section view of the beam 100 which is common to all modes of operation. An open beam concept provides a cavity or channel 116 for installing junction boxes, transformers, power supplies, etc., as well as providing a wire trough for connecting wiring. Three sets of tracks (118, 120, 122) along the vertical surfaces 112 allow the beam 100 to accommodate each of the modes of operation described in this disclosure. Each track features a locking tab (124, 126, 128, respectively) that prevents the structures mounted on the beam to spread outward and become disconnected from the beam, e.g., in the event of an unexpected high external load. Four slots (130*a*-130*d*) for installing LED lighting strips are provided on the lower surface 114. Several exemplary configurations of the beam 100 and connector sleeve 102 for adjoining adjacent beams are shown in FIGS. 16A-16D.

The preferred method of fabricating the beam 100 is an aluminum extrusion, which allows the use of long lengths, which are contemplated by the present development. In preferred embodiments, the beam 100 has a length of up to about 5.5 meters (18 feet) for a single assembly, although longer or shorter lengths are also contemplated. Many applications may require lengths longer than 5.5 meters, which may be accomplished by using a connector sleeve 102 and fasteners 104, such as quick release pins, to lock multiple assemblies together. In alternative embodiments, one of the connectors 104 could be replaced with a permanent fastener, such as a welded connection or the like.

An enlarged isometric view of a beam segment 100 having a connector sleeve 102 thereon appears in FIG. 1C. A cross sectional view of the beam 100 and connector sleeve 102 appears in FIG. 1D. The sleeve 102 may be an extruded member. The shape of the connector sleeve 102 closely follows the contour of the outer surface of the beam 100.

The exemplary embodiment of FIGS. 1A and 1E shows one method of supporting the lighting assemblies of the present disclosure in a building structure using cables or chains 106 having a first end fastened to an eyebolt or similar fastener 108 and a second end secured to an overhead structure 110, such as ceiling, beam, etc. The assembly may be supported at each end, as well as at intermediate positions therebetween, such as at each connector sleeve 102 securing adjacent beam segments 100. The eyebolt 108 includes a threaded end which passes through opening 103 in the connector 102 and may be secured with a threaded nut 109. Alternative methods for securing the lighting assembly herein to an overhead structure are described below.

The beam 100 is an elongate member including opposing, parallel upstanding sidewalls 112 and a horizontal base 114 extending therebetween to define a channel 116. In the illustrated embodiment, each of the sidewalls includes a lower track 118, a center track 120, and an upper track 122. The relative terms "upper" and "lower" refer to the orientation shown in FIGS. 1A-1E, wherein the unit is adapted for use in connection with a down lighting application, although it will be recognized that the unit could be used in other orientations, such as inverted for inverted of diffuse lighting applications.

The tracks 118, 120, and 122 each include a respective locking tab 124, 126, and 128, thereby defining a generally "L"-shaped channel. In alternative embodiments, each channel 118, 120, and 122 could include two locking tabs to define a generally "T"-shaped channel.

The base 114 of the beam 100 consists of one or more generally "T"-shaped slots 130*a*, 130*b*, 130*c*, and 130*d*. Four T-shaped slots are shown in the illustrated preferred embodiment, although other numbers of slots are also contemplated. The slots 130*a*-130*d* are dimensioned to receive LED strips 132, which are slidingly received in the slots and extend along the length of the beam 100 (see, e.g., FIGS. 1E and 3). The LED strips may be of the type containing a flexible circuit board or substrate encapsulated in a transparent or translucent polymeric resin and having a plurality of LED elements spaced along its length. The internal cavity or channel 116 of the beam 100 is dimensioned to accept a DC power supply 140 to power the LED strips 132. The open beam design illustrated herein is preferred as it permits easy access to wiring.

A junction box 170 is also received within the channel 116 and included a cord 142 having a standard AC plug 143. One or more AC outlets or sockets 171 may also be provided on the junction box 170. The power supply 140 includes a power cord 142 with plug 143 for connection to the AC outlet 171 on the junction box 170. The junction box 170 is electrically coupled to an AC power supply, such as a standard AC outlet of the building or structure in which the unit is installed, either directly or via one or more like junction boxes in adjacent attached segments, for example, wherein multiple units are adjoined using connector sleeves 102.

The power supply 140 includes transformer/rectifier circuitry 144 for providing a direct current (e.g., 12 volt) output to the lighting strips 132, via lead wires 145. In this manner, any number of lighting units may be connected, up to the amperage limits of the AC circuit. A cover 196 is slidably received within parallel channels 198 (see FIG. 9) on the sidewalls 112 to enclose the wiring and electronics.

A significant advantage of the lighting system presented in this disclosure resides in the ability to interconnect assemblies without the use of building hard wiring once the first assembly has been plugged into a switched outlet. Subsequent assemblies may then be plugged into to the assembly ahead of it in an outlet 171 provided in the junction box located on the channel 116. The power cord 142 must of sufficient current capacity to handle the full current load of all assemblies in the branch circuit.

The connector sleeve 102 may be permanently attached, e.g., via welding at one end to a first beam 100 in overhanging fashion, such that the overhanging portion of the sleeve 102 can be removably secured to another beam 100 with a removable fastener 104. Alternatively, the connector sleeve 102 could be removably secured at each end to adjacent beams 100 (see FIG. 1A).

Figure 2:
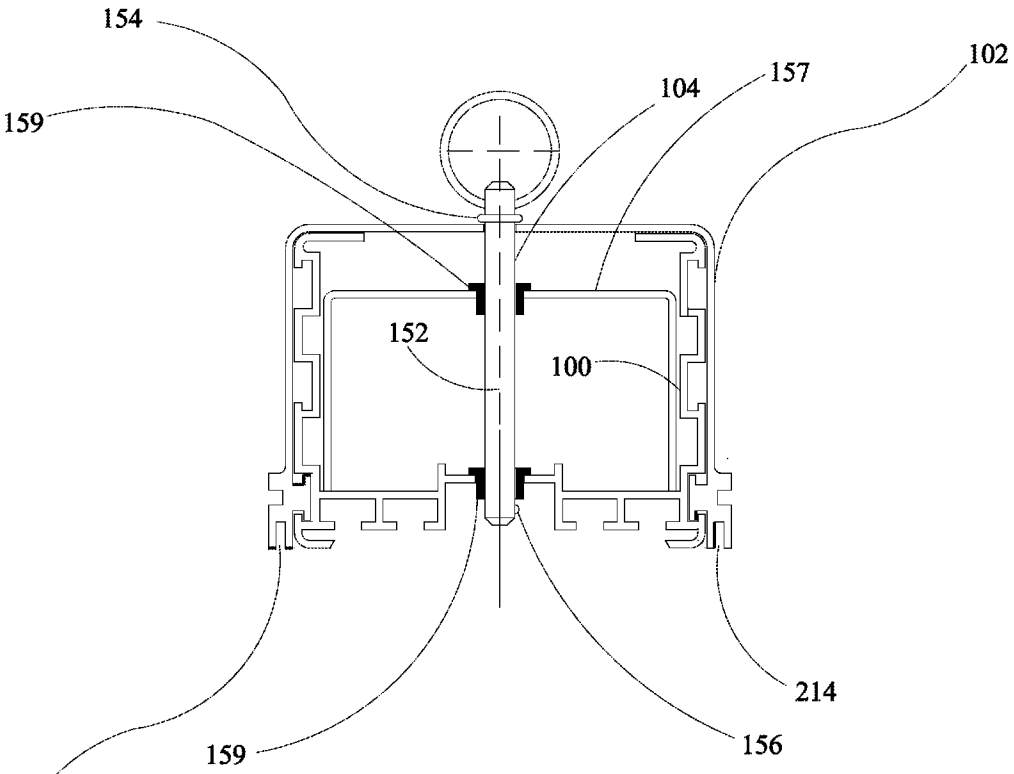
FIG. 2 is a cross-sectional view illustrating the method of removable attachment of the beam to the connector sleeve.

The preferred method of removably attachment between the connector sleeve 102 and a beam 100 is best seen in FIG. 2. The beam member 100 may be secured to the connector sleeve 102 using a fastener 104 passing through an opening 105 in the connector sleeve 102 and a flanged bearing 159 received in a vertically aligned opening in an inverted generally U-shaped bracket 157, and passing through a second vertically aligned flanged bearing 159 received in a vertically aligned opening in the transverse portion 114 of the rail 100. The pin 104 removably secures the connector sleeve 102 and the rail member 100 in fixed relative position. Preferably, the fastener 104 is a quick release pin, e.g., of the type having a shaft 152 with an enlarged diameter portion 154 at one end and a resilient spring biased retaining ball 156 at its opposite end. It will be recognized that other fasteners types such as threaded fasteners, clips, and so forth.

Figure 3:
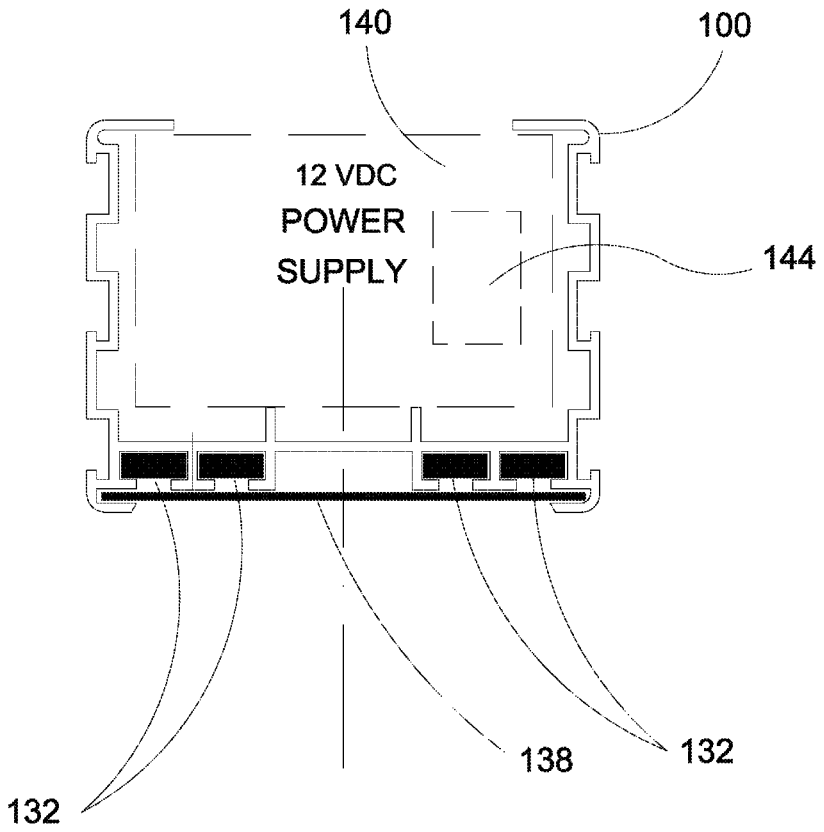
FIG. 3 is a cross-sectional view of the embodiment appearing in FIG. 1A.

Referring now to FIG. 3, and with continued reference to FIGS. 1A-1E and FIG. 9, the exemplary rail 100 also includes slots 136 for slidably receiving a light diffuser below the lighted strips. A variety of diffusers may be employed, including but not limited to flat transparent or translucent panels, patterned sheets, egg crate type diffusers, perforated diffusers, and the like. A panel-type diffuser 138 appears in FIG. 3. Alternatively, for example, an egg crate diffuser having parallel flanges for sliding engagement with the channels 136 may be employed.

LED lighting strips 132 are available with densities of up to 120 LED/meter, requiring a power input of 12 watts/meter. This input is approximately the same as the power input requirements of LED T8 fluorescent lamps. Assuming the same lighting efficiency for each application, the LED unit herein operating in the light bar mode as illustrated in FIGS. 1A and 3 is capable of as much light output as a four tube wide fluorescent fixture at a much reduced cost and size. One drawback of the strip LED 132 is that it is typically not dimmable and typically only operates at one color temperature. This is not the case with new developments related to some new tube type LED lamps.

Referring now to FIGS. 4 and 5A-5C, there is shown a second, tube lamp mode of operation of the lighting apparatus herein. The tube lamps are preferably LED lighting tubes, although the use of fluorescent tube lamps, including conventional fluorescent tubes or high efficiency fluorescent tubes, is also contemplated.

Figure 4:
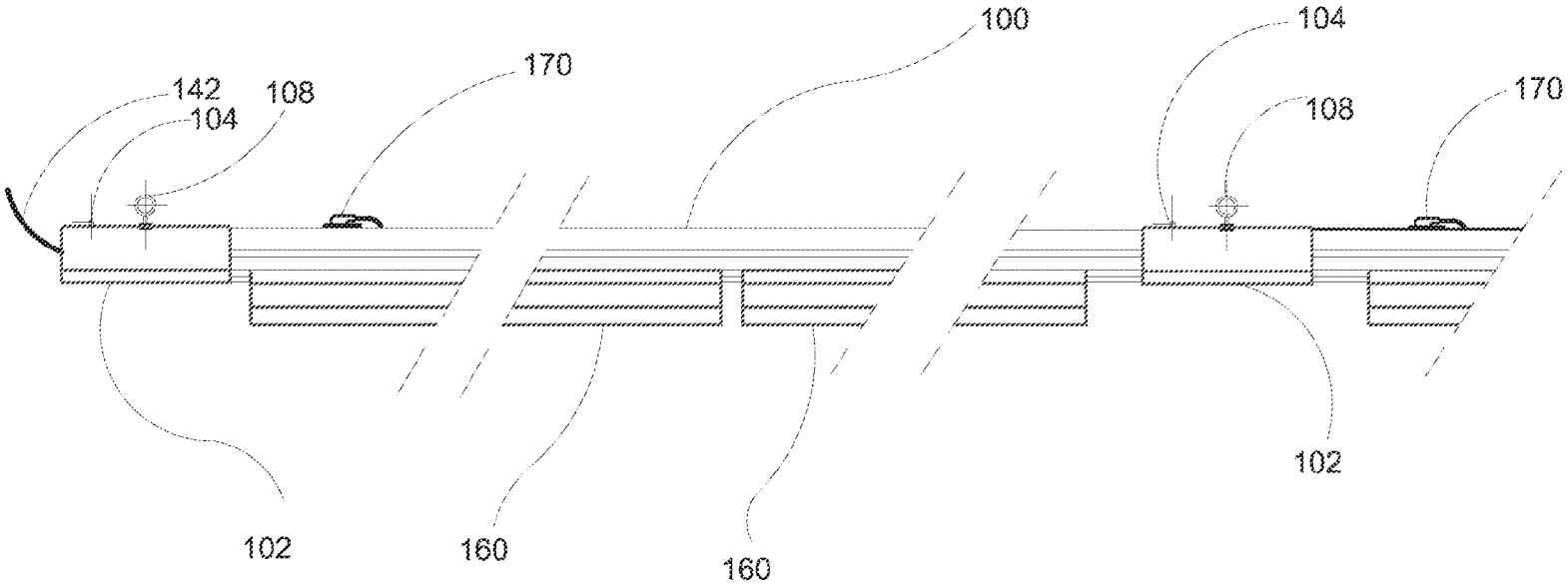
FIG. 4 is a side view of an exemplary tube lamp embodiment therein.

FIG. 4 shows an assembly layout of the tube lamp mode wherein multiple assemblies may be connected using a connector sleeve 102 with fasteners 104 coupling adjacent units in a manner similar to the connection methods described above by way of reference to the light bar mode appearing in FIGS. 1A-1E, with like reference numerals referring to like components.

In the tube lamp mode, the LED strips and 12V DC power supply are omitted from the rail 100. Depending on the length of the rail 100, one or more LED tube subassemblies 160 may be slidingly attached to the rail 100. The LED tube subassembly 160 includes an elongate light reflector 162, which may be a one-piece extruded member, and which also functions as a mounting chassis for LED lighting tubes 164, as shown on FIG. 5A.

Figure 5A:
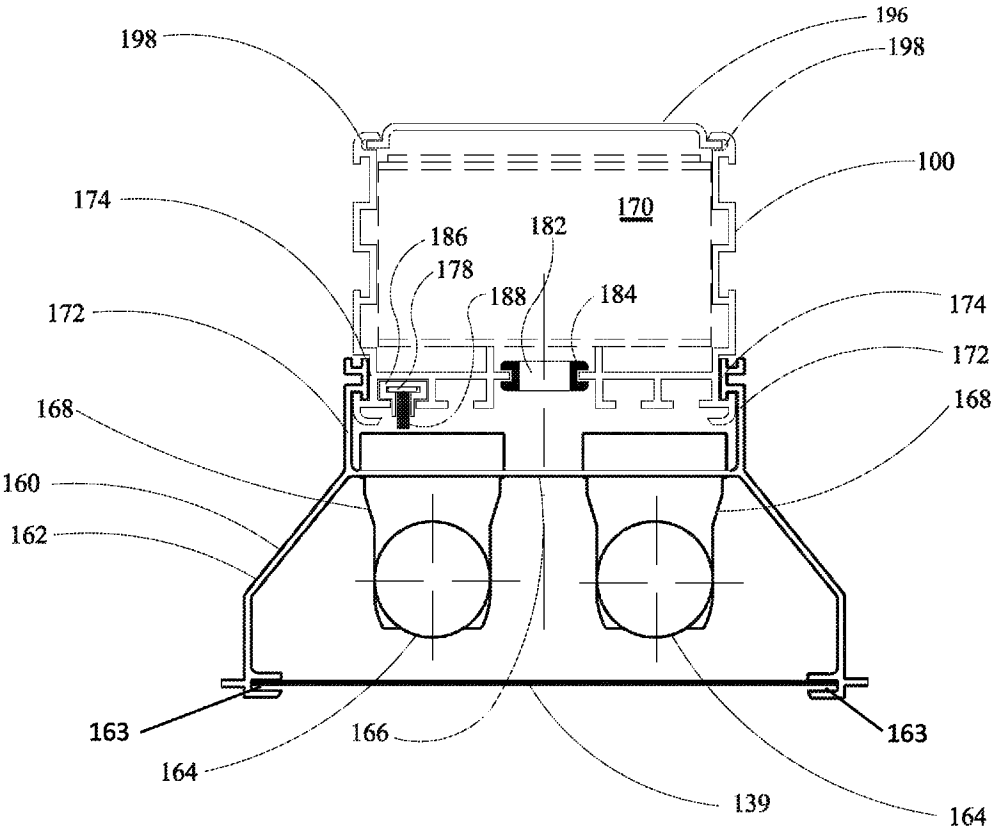
FIG. 5A is a cross-sectional view of the embodiment appearing in FIG. 4.

As best seen in FIG. 5A, the light reflector 162 includes a transverse portion 166 having tube sockets 168 mounted thereon. The LED tube assemblies 160 are wired on the reflector chassis 162 prior to installation onto the beam 100. The tube sockets 168 are located in punched or machined holes formed in the transverse surface 166 and then wired in parallel for 110 V AC operation. The tube subassemblies 160 are slid onto the beam 100 with input power leads fed thru a grommet 184 (see FIG. 5A) to the junction box 170. Alternatively, lead wires can be run along the rail channel 116 and around the end of the rail 100.

The tube sockets may be a commercially available bi-pin socket, such as such as Leviton socket #13351. The tube sockets 168 allow the LED lighting tubes 164 to be mechanically and removably secured to the reflector subassembly 160 and may provide mechanical attachment in a manner similar to conventional fluorescent tubes. The sockets 168 also provide an electrical connection to a power supply, such as the AC mains of the building or structure in which the unit is installed. Electrical contacts on the sockets 168 are electrically coupled to an electrical junction box 170 received in the channel 116 of the rail member 100. The junction box 170 includes a power cord 142 for electrical connection to a wall outlet or the junction box of an adjacent beam member 100, as the case may be. The tube sockets 168 are mounted into the reflector structure 162 by fastening them into rectangular holes formed in the transverse portion 166.

The reflector member 162 includes opposing, upstanding sidewalls 172 having inward facing rails 174 which are complimentary with the rails 118 on the beam 100. In the illustrated embodiment, the rails 174 are generally T-shaped in cross-section to provide a secure connection by interlocking with the locking tab 124. The reflector 162 structure may be fabricated as an aluminum extrusion, molded or extruded plastic, etc. Plastic is the preferred material due to its high impact resistance, low weight, and finish characteristics. It will be recognized that the reflector portion 162 may have other cross-sectional shapes including curved, parabolic, etc. The interior surface may be coated with a metal or other reflective material.

Figure 5B:
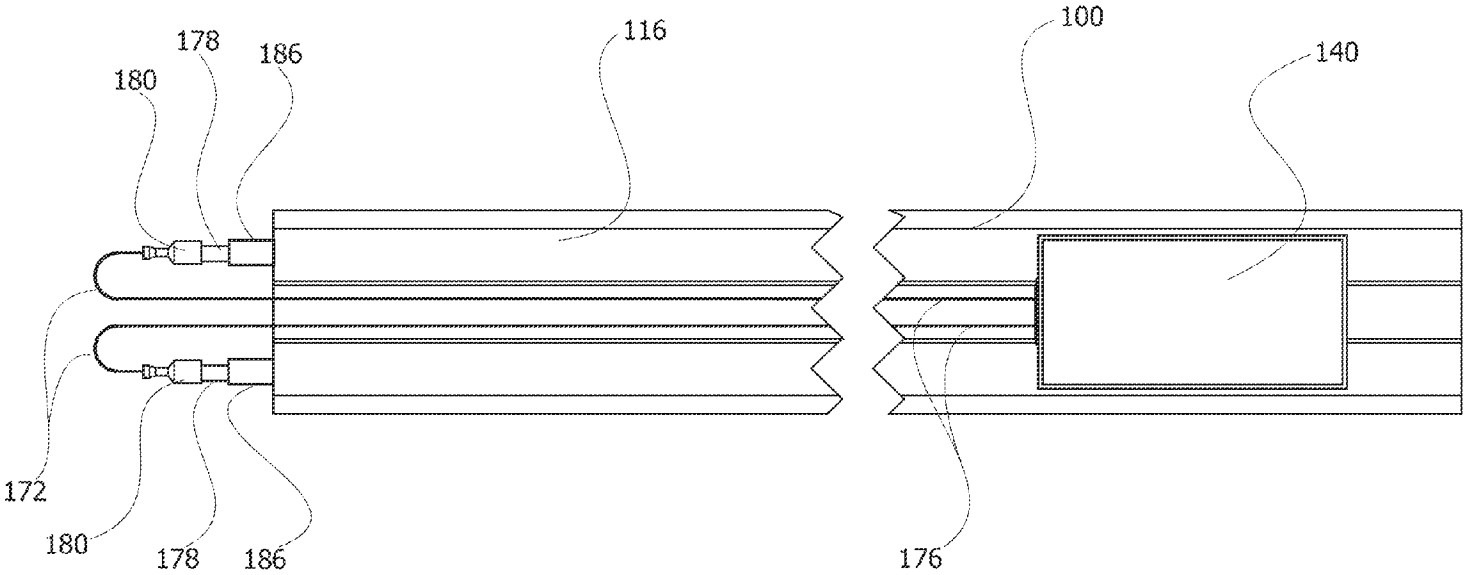
FIG. 5B illustrates an exemplary manner of electrically coupling flat conductors to a junction box.
Figure 5C:
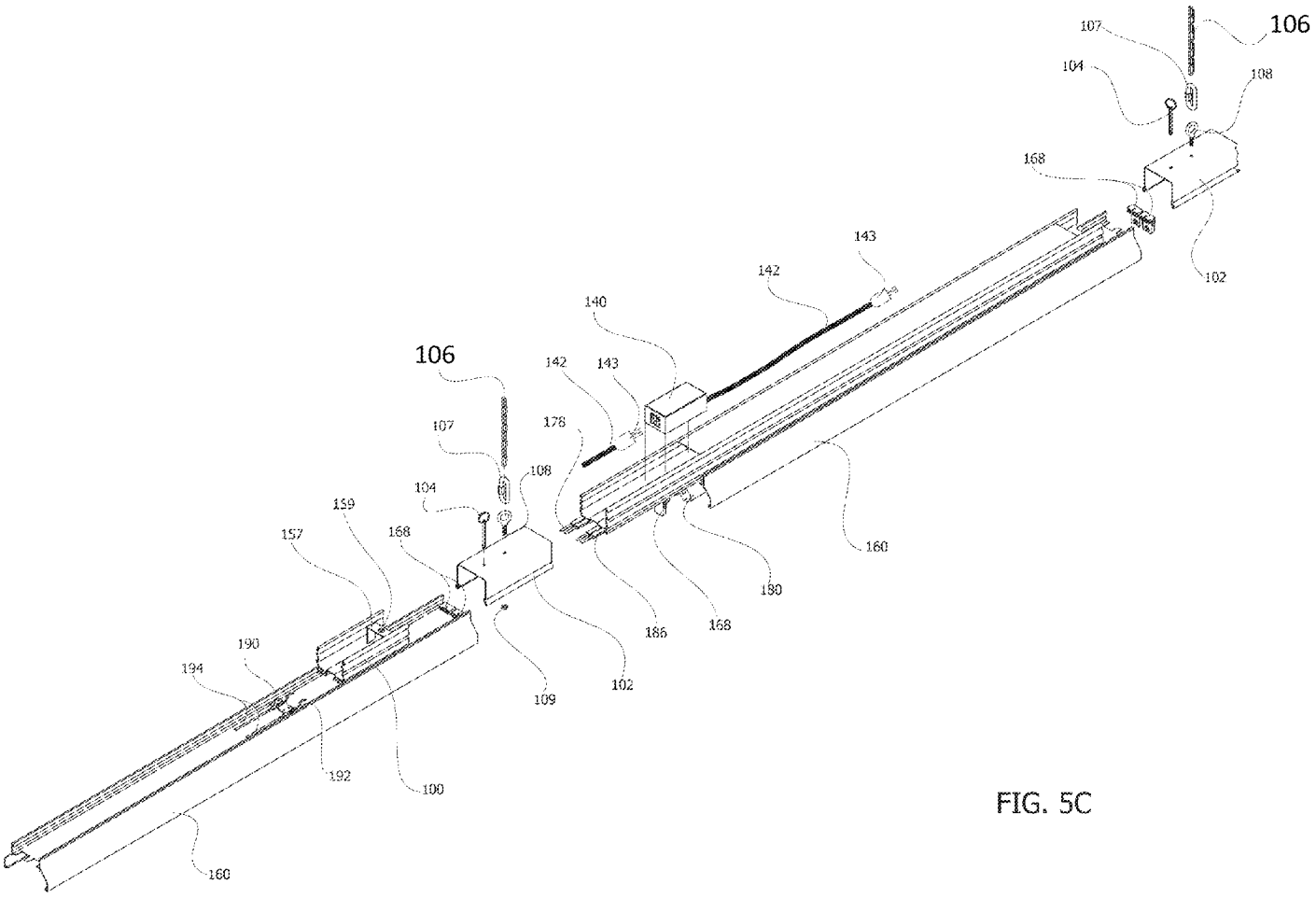
FIG. 5C is a partially exploded isometric view of an exemplary lamp mode embodiment herein.

The present development is advantageous in that wiring operations may be performed prior to installation of the reflector assembly 160 onto the rail member 100. Power from the AC mains of the building or structure is provided to the junction box 170 via the cord 142. As best seen in FIGS. 5B and 5C, a pair of lead wires 176 (e.g., 18 AWG round insulated wire) extend from the junction box 108 along the channel 116. Each of the lead wires 176 is electrically coupled to a corresponding flat conductor 178, e.g., using a terminal connector 180. The lead wires may pass through an opening 182 formed in the transverse member 114 and grommet 184 provided for this purpose (see FIG. 5A).

Each of the flat conductors 178 runs in a respective one of the axially-extending channels 130*a*-130*d*. The flat conductor 178 is received within an insulating sleeve 186 having a downward-facing, axially-extending opening. An electrical contact block 190 is secured to the upper facing surface of the transverse section of the transverse member 166 of the reflector 162. Electrical contacts 192, such as brush contacts, spring contacts, or the like, are secured to the contact block 190. A pair of lamp socket lead wires 194 are each attached at one end to the contact block 190 and at the other end to an appropriate terminal of one of the tube sockets 168. In operation, the brush or spring contacts 192 extend through the axially-extending opening in the insulating sleeve 186 to bear against the flat conductor 178 to thereby provide an electrical connection between the flat conductors 178 and the respective terminal of the lamp socket 168.

The lower portion of the reflector 162 includes a pair of opposing axially-extending slots 163 for receiving a diffuser panel 139 or other light diffuser including egg crate and others as described above. An elongate plastic cover 196 may likewise be received in the opposing, axially-extending slots 198 formed at the upper end of the upstanding sidewalls 112 of the beam 100.

Figure 6:
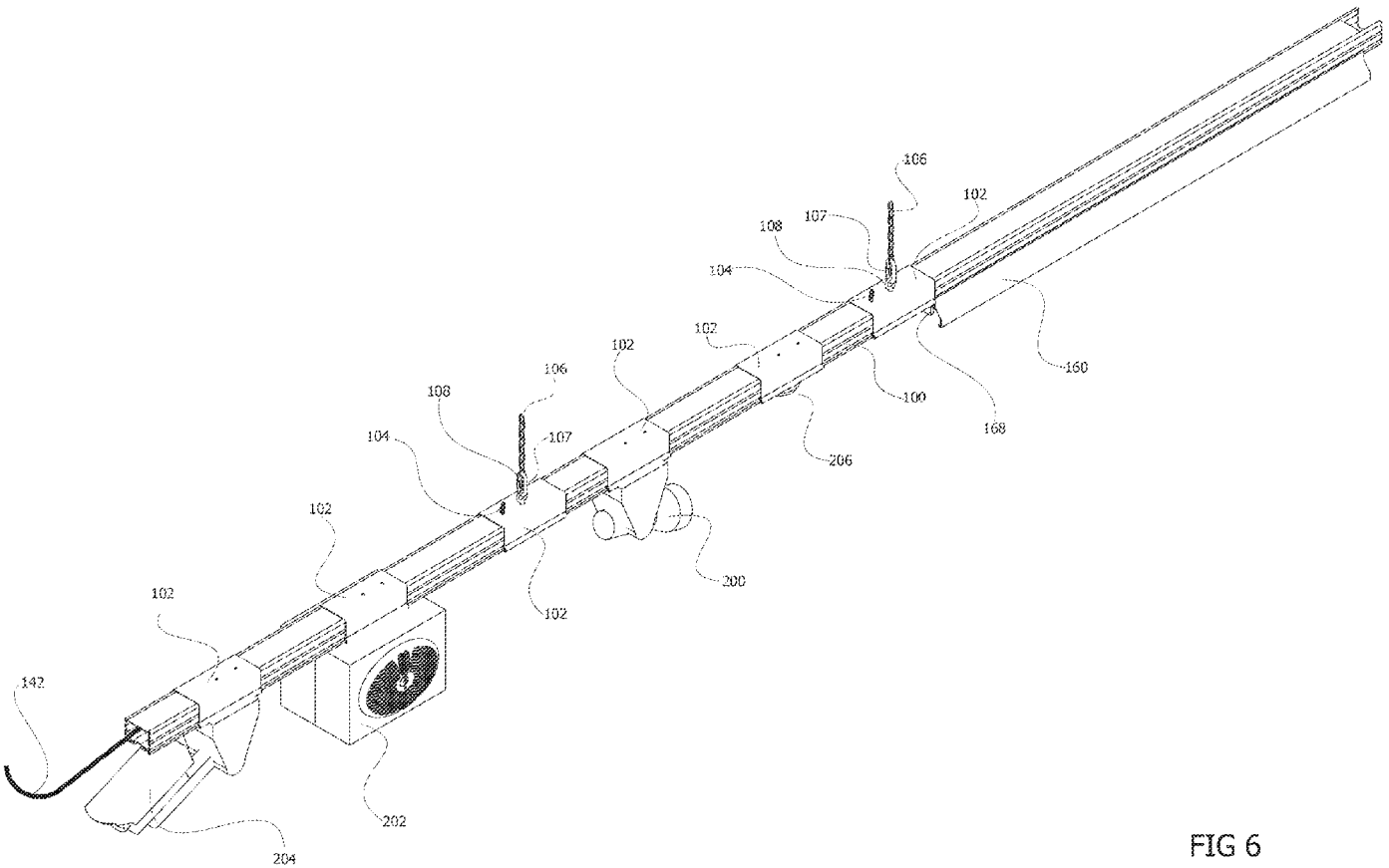
FIG. 6 is an isometric view of an exemplary system in a component-carrying mode of operation.

Referring now to FIG. 6, there is shown a further embodiment wherein the rail beam 100 herein is used as a platform for mounting various other electrical, electronic, and/or electromechanical devices. The embodiment of FIG. 6 takes advantage of the convenient (e.g., overhead) location in which lighting systems are typically installed, the availability of electric power in the beam 100 and the universal design of the rail for mounting one or more of any of a variety of components, including without limitation, a light, such as a lighting fixture 200, such as a spotlight, flood light, stage lighting, lighting effects, etc., which may be LED, incandescent, halogen, fluorescent, and so forth; an audio system 202 such as loudspeakers, audio amplifier, etc.; security camera 204; smoke detector or other sensors 206, and so forth.

Figure 7:
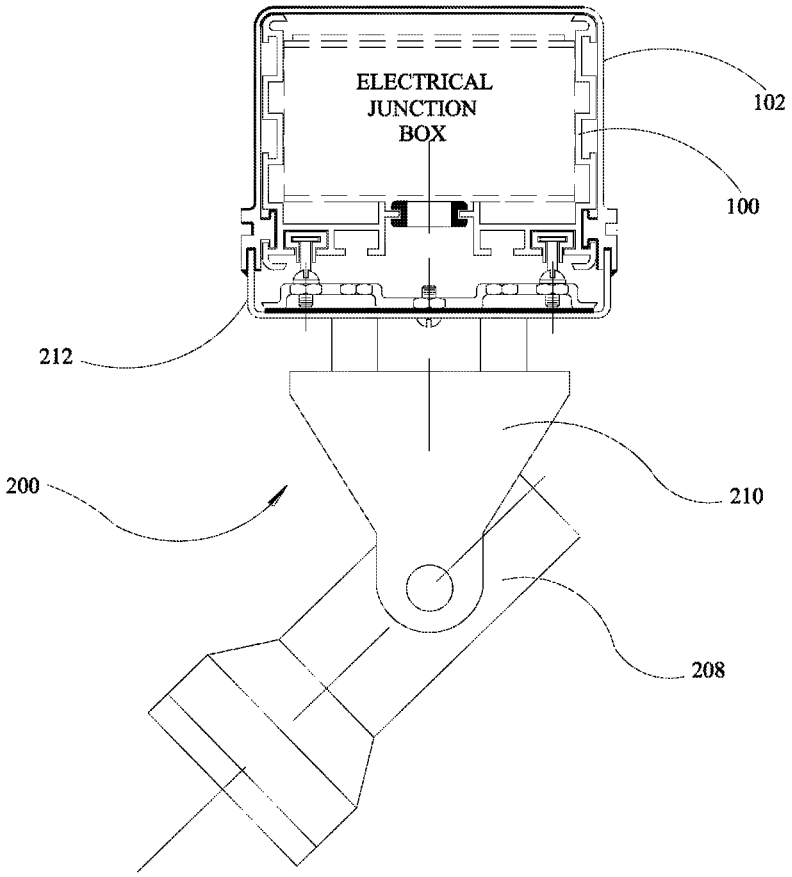

FIG. 7 demonstrates an exemplary method for mounting components to the rail 100 employing a section of a connector sleeve extrusion 102 as the interface to the system. The spot/flood light 200 includes a housing 208 which is pivotally attached to a swivel member 210, which in turn is rotatably attached to a mounting plate 212. The plate 212 includes upstanding edges which are received in complimentary facing grooves 214 (see FIG. 2) in the connector piece 102. The lighting fixture 200 is one example of the various designs that readily interface components into the lighting system. Such components may be introduced anywhere in the system as an alternative to the LED tube fixtures 160 or may be employed in addition to the LED/tube fixtures 160.

Figure 8A:
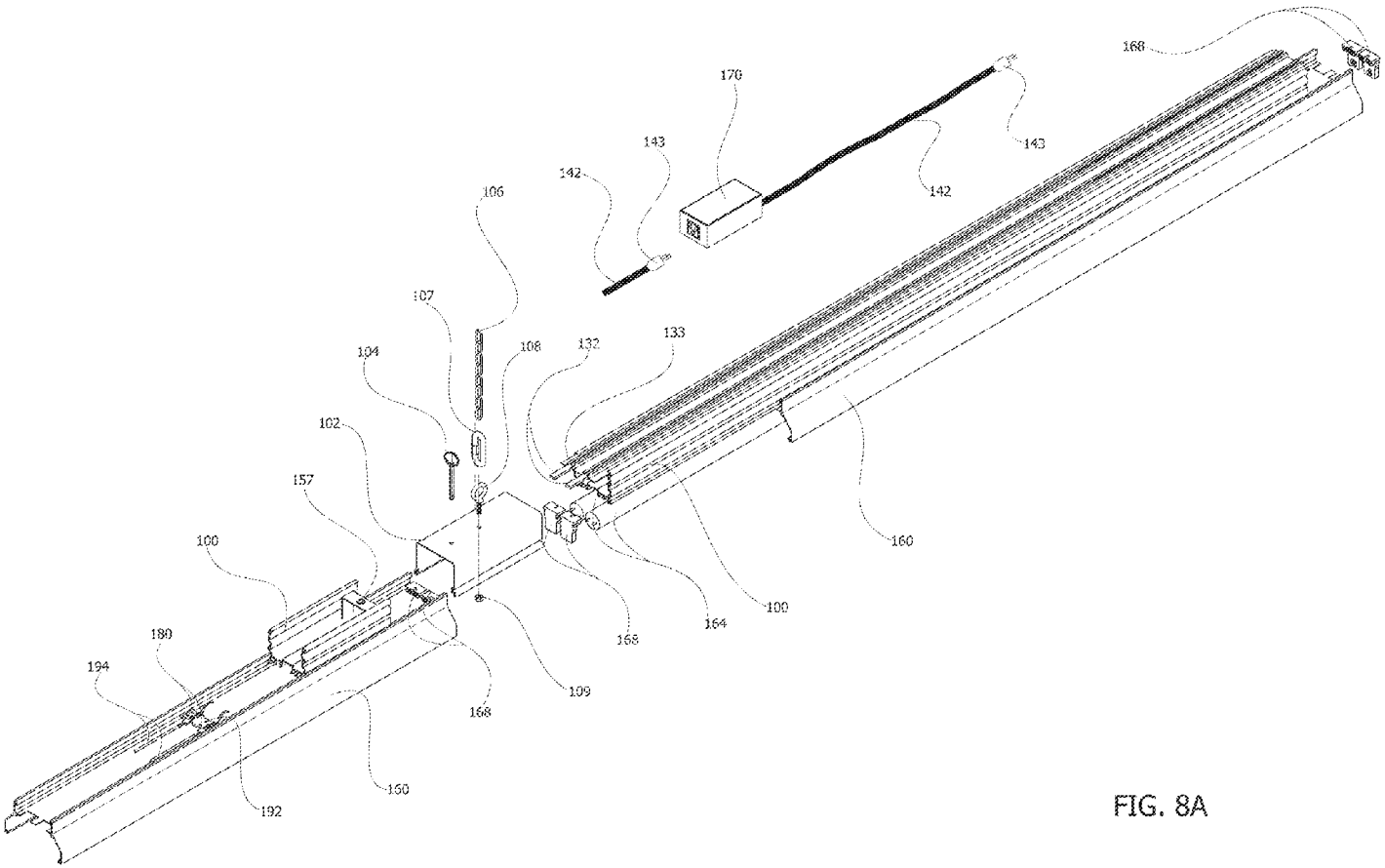
FIG. 8A is a partially exploded isometric view of an exemplary bi-directional system herein.
Figure 8B:
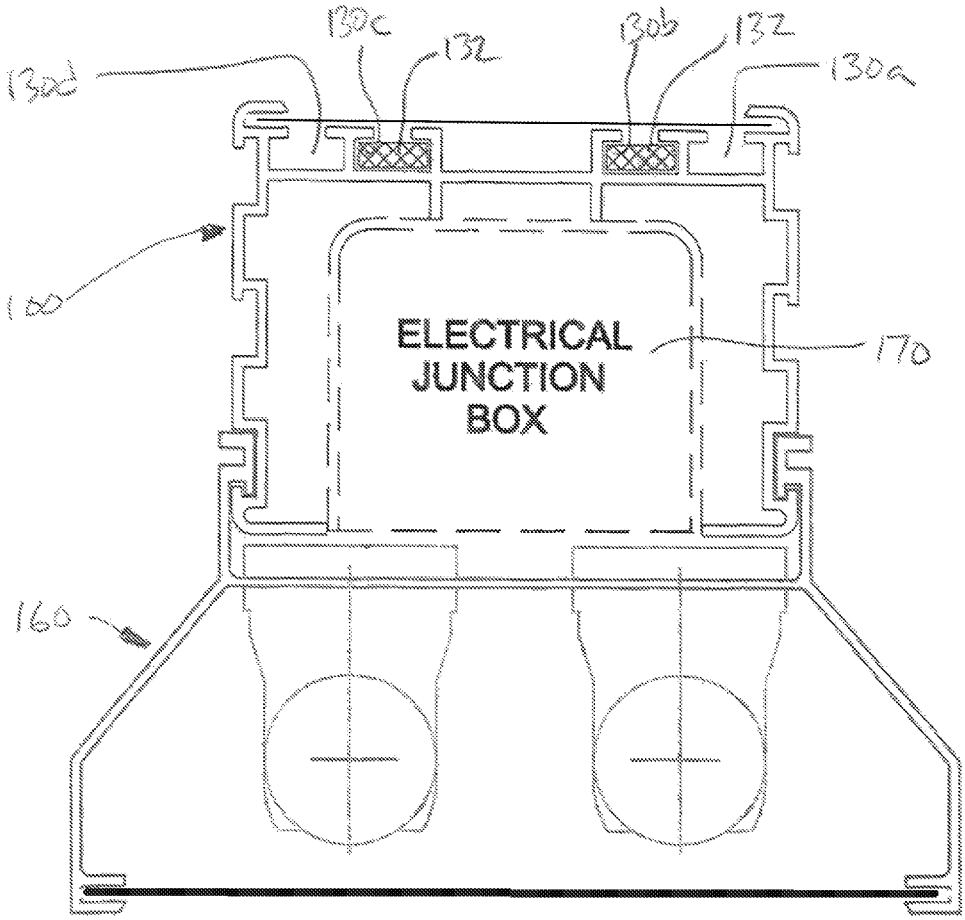
FIG. 8B is a cross-sectional view of an alternative bi-directional embodiment employing an inverted rail member.
Figure 8C:
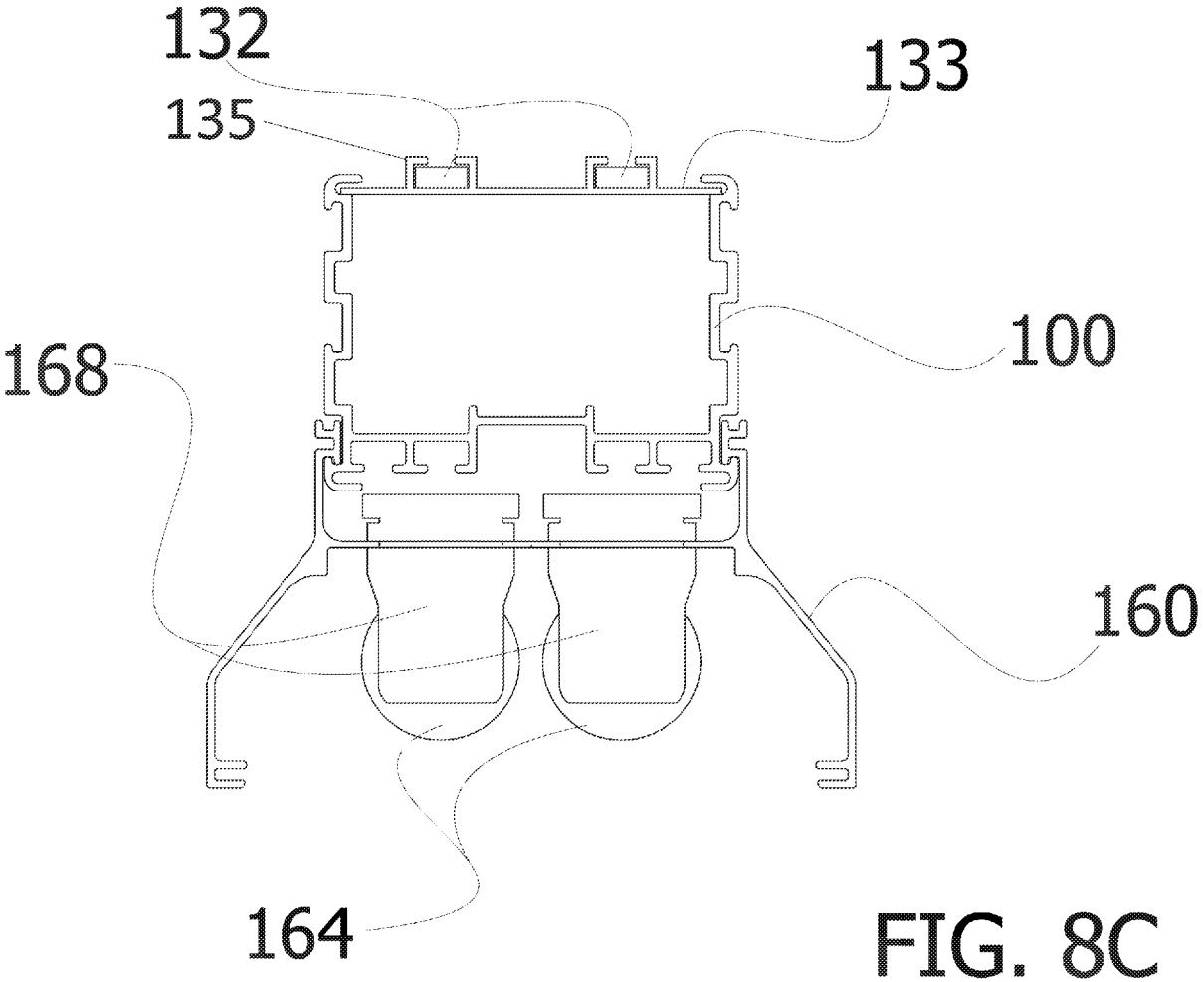
FIG. 8C is a cross-sectional view of the system appearing in FIG. 8A.

Referring now to FIGS. 8A and 8C, there is shown a bidirectional mode of operation of the lighting system herein, illustrating the versatility of the present development. The bidirectional mode of operation utilizes a rail members 100 adjoined as described above and having reflector assemblies 160 with tubular lamps 164 providing down lighting as detailed above with like reference numerals appearing in FIGS. 8A and 8C being as described elsewhere herein. Up lighting is provided by LED strips 132 which are slidably received in axially-extending channels 135 formed in an elongate panel 133. The panel 133 has two channels 135 for receiving the LED strips 132 in the illustrated embodiment, although other numbers of channels/strips are contemplated.

In a second bidirectional mode, appearing in FIG. 8B, the rail beam 100 is inverted relative to the orientation of the rail 100 in FIGS. 8A and 8C. One or more (two in the illustrated embodiment of FIG. 8B) LED strips are received in the channels 130*a*-130*d*, which face upward thus permitting upward lighting.

Lighting in a downward direction may be implemented using the track 122 for mounting the LED tubes assembly 160. One or more sections of the connector sleeve extrusion 102 may also be used to secure multiple beams 100 in end to end fashion as detailed above. Likewise, sections of the connector 102 may also be used to employ components as described in FIGS. 6 and 7 as an alternative to the LED assembly 160 or in combination therewith. A separate electrical junction box 170 and 12-volt power supply 140 (not shown) may be provided in the channel 116. In preferred embodiments of the bi-directional modes, upward and downward lighting may be controlled independently.

Figure 10:
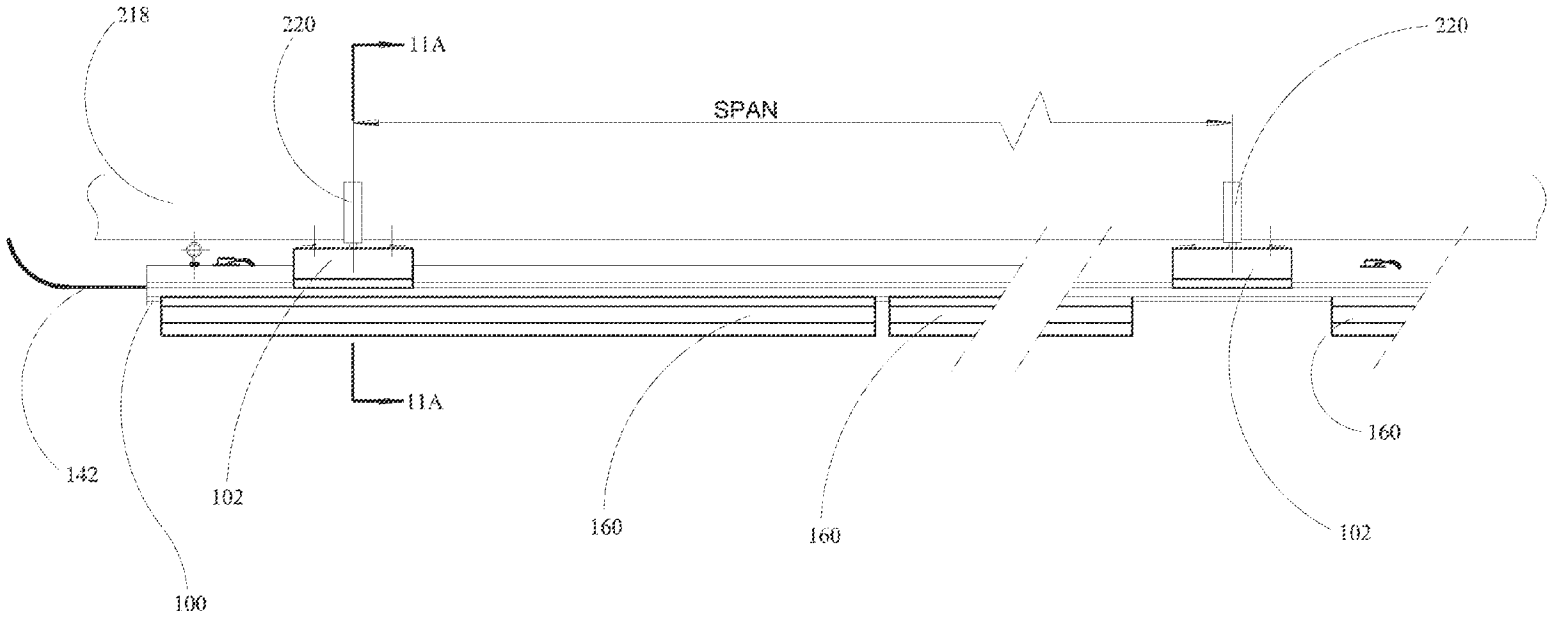
FIG. 10 is a side view illustrating an alternative method for attaching the system herein to an overhead structure.
Figure 11A:
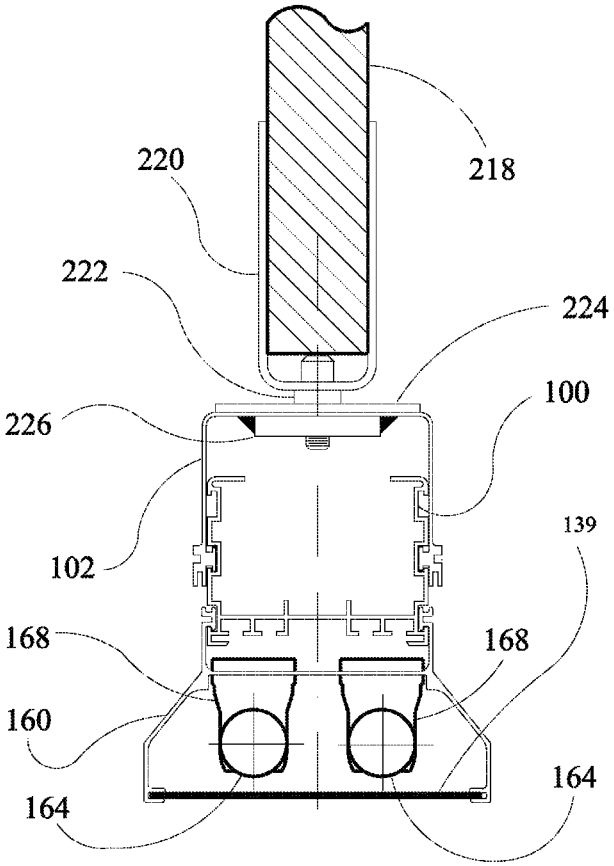
FIG. 11A is a cross-sectional view taken along the lines 11A-11A in FIG. 10.
Figure 11B:
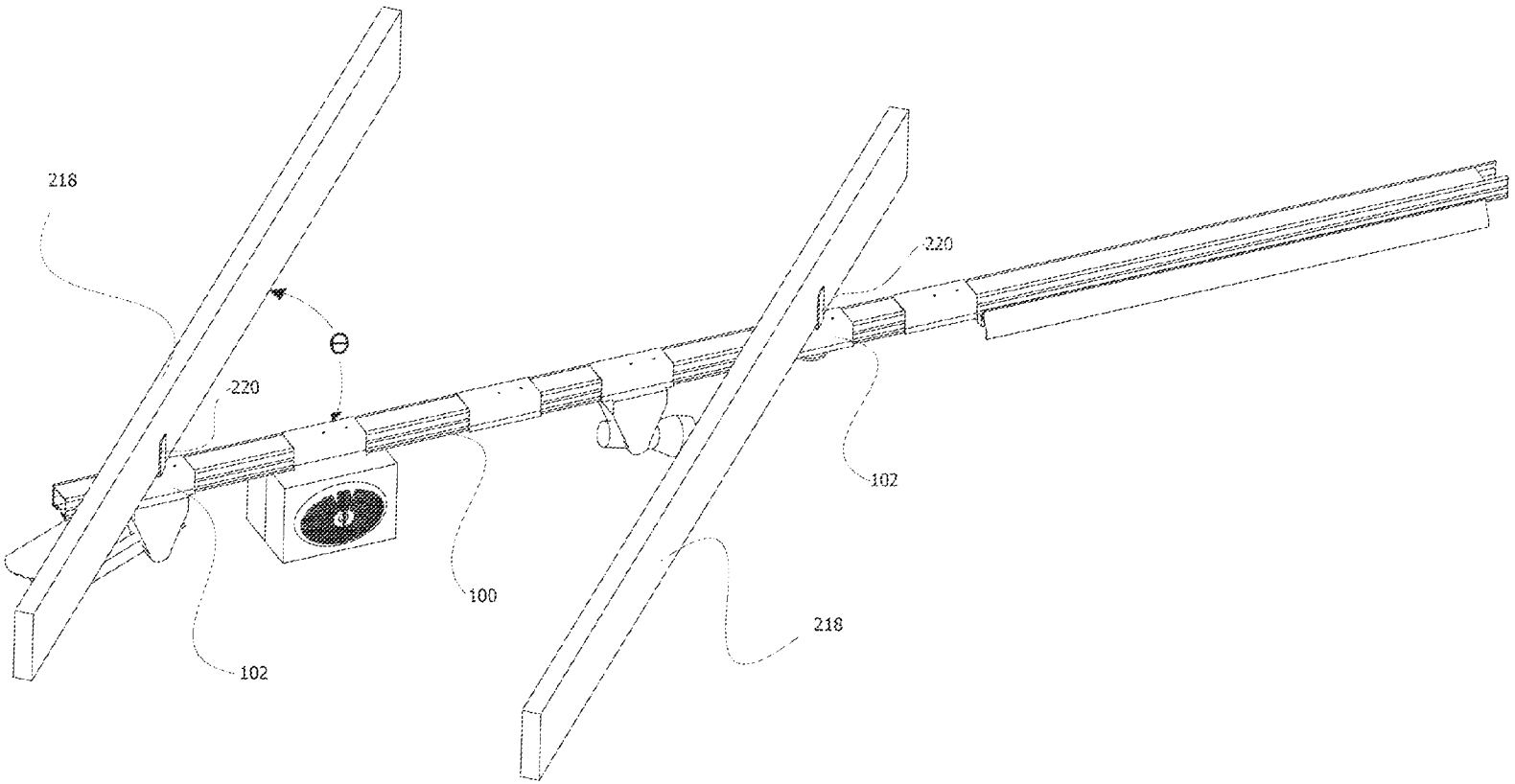
FIG. 11B is an isometric view illustrating the use of a swivel fastener to attach a lighting system herein at a desired angle θ relative to overhead joist or beam elements.

FIGS. 10 and 11A illustrate an alternative to chain or cable mounting where building support beams, rafters, roof joists, etc. 218 are available. This installation method employs a section of connector sleeve 102 which has been modified to function as a base for a swivel mount which includes a yoke or fork 220 which is rotatably fastened to the sleeve section 102 via a pivoting fastener 222. Washers, bearing plates, or the like 224 and 226 may be provided to strengthen or prevent deformation of the connector sleeve section 102 under load. The yoke 220 may be secured to the beam 218 with screw or bolts (not shown). The swivel feature allows the lighting system to be mounted parallel, perpendicular, or, as shown in FIG. 11B, at any desired angle θ relative to the beams 218. The span is infinitely adjustable since the connector sleeve 102 may slide to any position using the center track slots 120 of the rail 100, although other slots on the beam 100 could be used. For example, in light bar mode with the reflector assembly 160 omitted, the connector sleeve 102 with the beam mounting for 220 could be attached to the beam 100 using the lower slots 118. Installation may be accomplished as shown in FIG. 10 with the connector sleeve at the connection between multiple assemblies or using two or more connector sleeves on a single assembly.

Figure 12A:
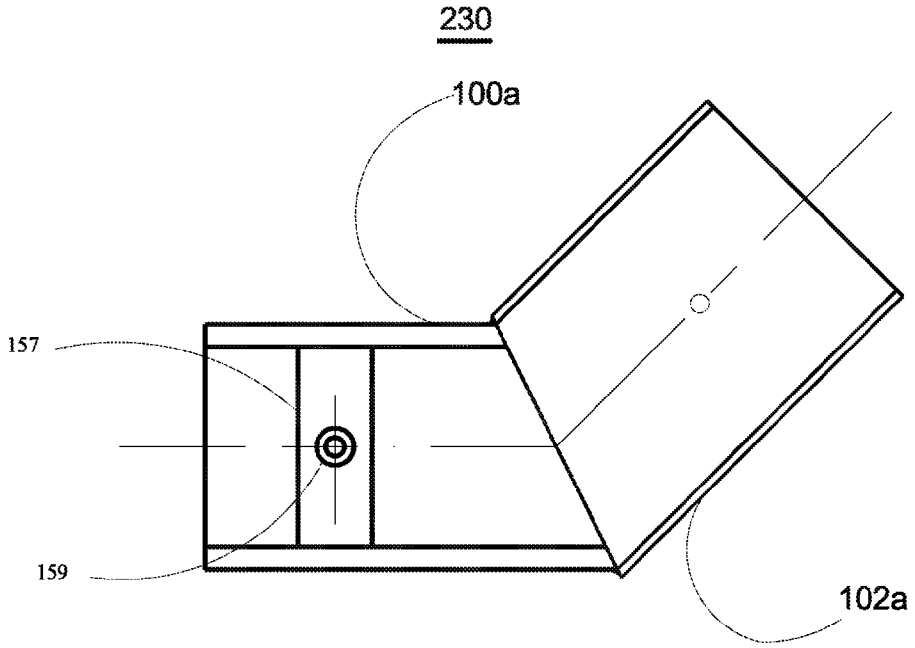
FIGS. 12A and 12B illustrate two exemplary nonlinear connector fittings.

Connecting assemblies using the connector sleeves 102 described in this disclosure is not limited to straight line connections. In applications requiring large areas to be illuminated, changes in direction of the lighting array may be desired. The present system may achieve this by using fittings fabricate from the same extrusions obtained from the linear sections described above. For example, FIG. 12A illustrates an exemplary angled connector 230 comprising a section of main rail extrusion 100*a* and a section of connector sleeve extrusion 102*a*, each being saw cut at the required angles and spot welded together to the angled fitting 230. A support plate 157 and flanged bearing 159 may also be provided for using a quick connect fastener, such as the pin 104 as described above.

The illustrated fitting 230 is a 45° ⅛ tum fitting, although it will be recognized that the connector 230 could be any desired angle. This fitting may then be inserted into a straight section in the same manner used to connect straight sections (e.g., using a quick release pin or like fastener). A second fitting 230 could be inserted in a similar manner into the first fitting 230 to complete a 90° turn. For a 90-degree turn employing two 45° fittings 230, a straight section may optionally be inserted between the two 45° fittings. FIG. 12A shows a left hand turn, whereas a right hand turn fitting may be constructed by simply reversing the direction of the interior saw cuts.

Figure 12B:
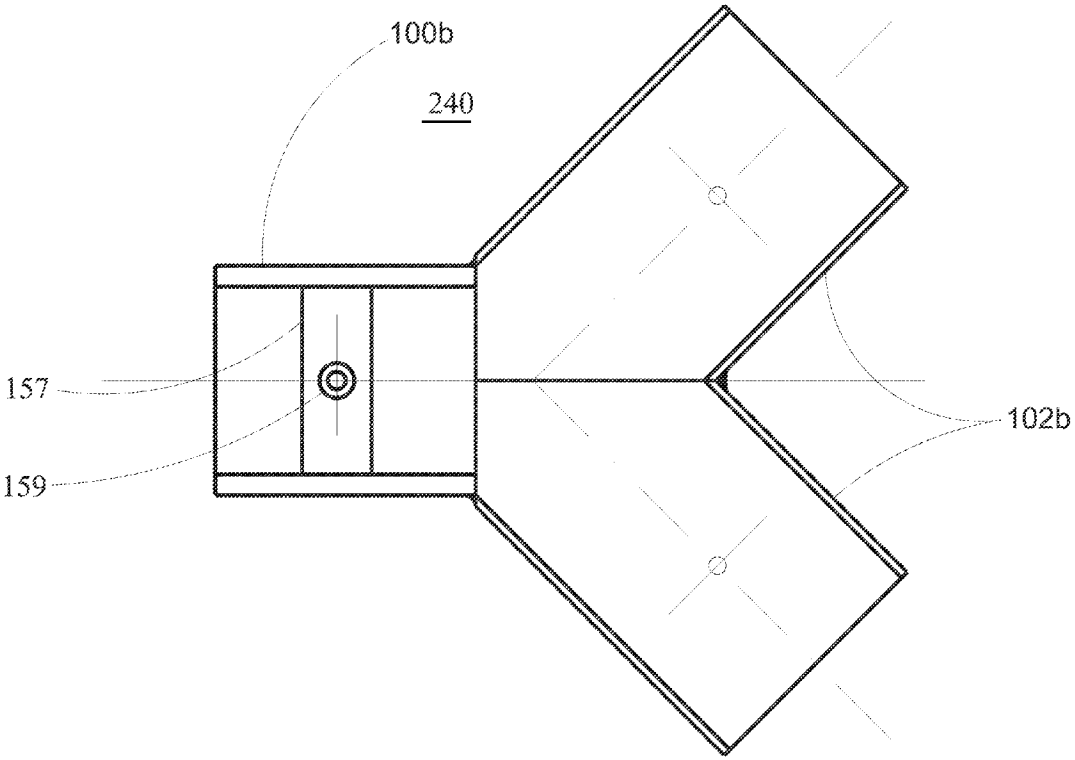

FIG. 12B illustrates a "Y" connector 240 that is constructed using a short section 100*b* of the main rail extrusion and two short sections 102*b* of the connector sleeve extrusion. To construct the connector 240, a 90° fitting may be fabricated by spot welding the two short sections of connector sleeve extrusions 102*b*, each cut at 45° at one end. This 90° subassembly may then be cut to fit the end of the short section 100*b* of the main rail extrusion and welded to the sections 102*b* to complete the Y-connector 240. Electrical power may be provided at the branched connection by providing a second outlet and junction box to the linear assembly that it connects to in order to feed both branches of the Y-connector 230. A support plate 157 and flanged bearing 159 may also be provided for using a quick connect fastener, such as the pin 104 as described above. Alternatively, two short lengths of power cord with female connectors on each cord may be connected at the junction box.

In still further embodiments, the lighting system in accordance with the present disclosure may be adapted for use in connection with a suspended ceiling system of the type installed on a grid system suspended from a higher ceiling with cables, chains, wires, etc. Typical commercially available hardware is based upon a 2'×4' grid, with most of the grid filled with 2'×4' solid tiles or lighting fixtures. The prevalent design for the conventional fluorescent grid fixture utilizes a 2'×4' chassis with two or more (typically four) fluorescent tubes integrated into the chassis structure.

Figure 13A:
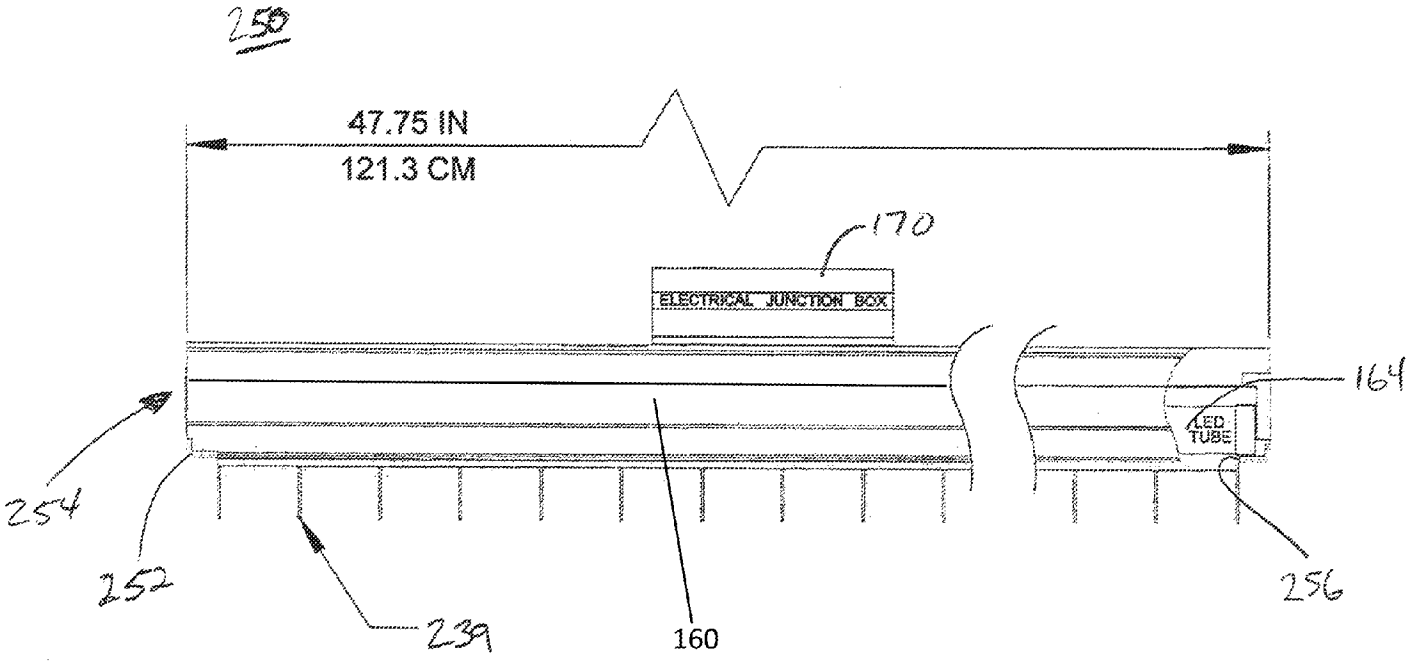
FIGS. 13A-13C and FIG. 14 illustrate an exemplary embodiment adapted for use in connection with a suspended or drop ceiling system.
Figure 13B:
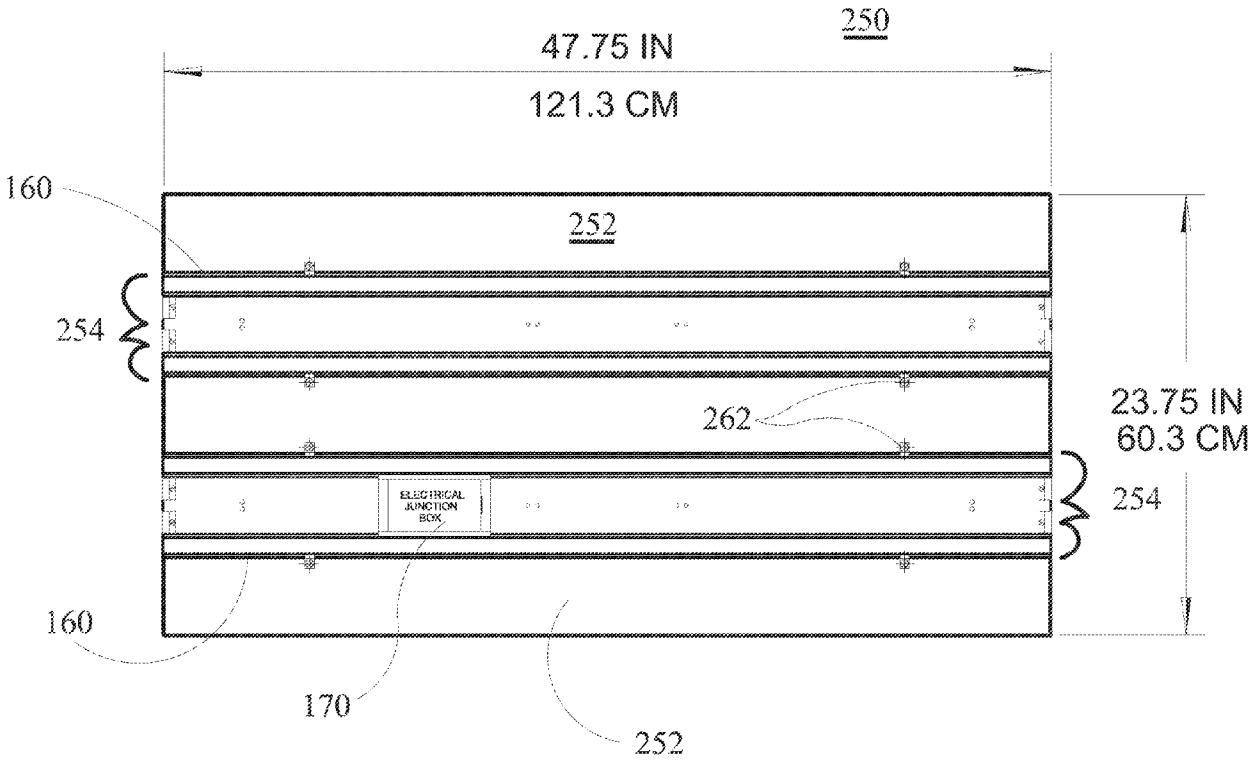
Figure 13C:
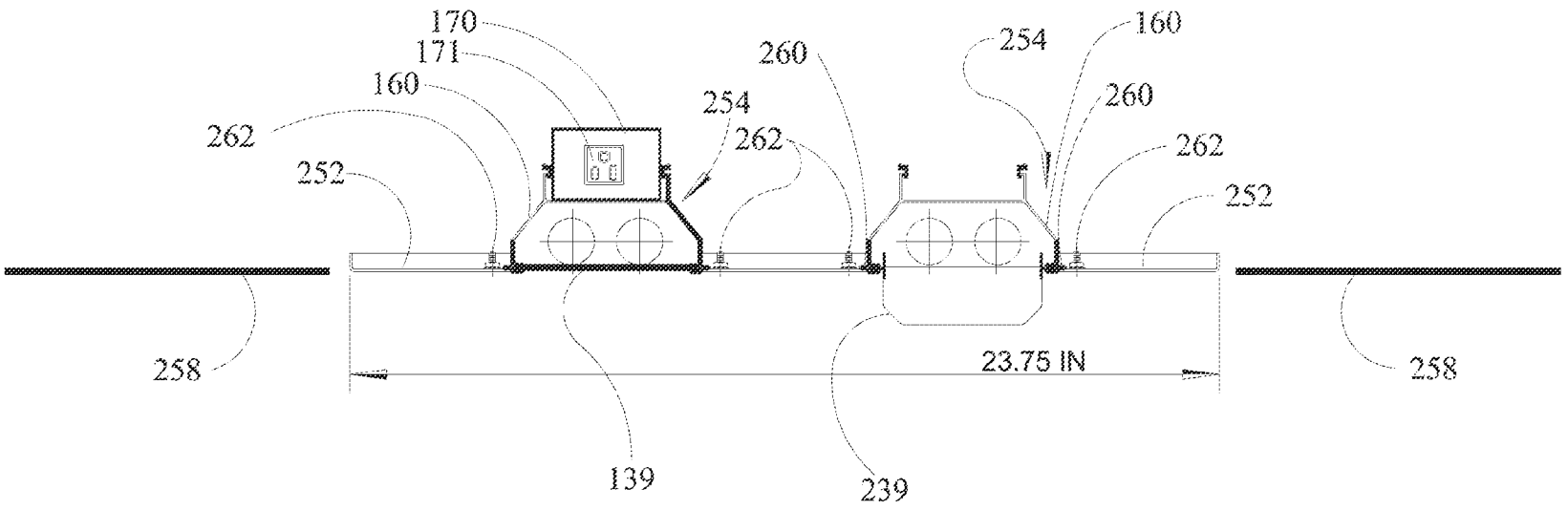

Referring now to FIGS. 13A-13C, there is shown a further embodiment lighting fixture 250, which includes a mounting tray 252 having one or more (two in the illustrated exemplary embodiment) separate light assemblies 254 fastened to the tray. The mounting tray 252 is designed to accommodate the light modules 254 by providing rectangular openings 256 slightly larger than the downward face of the module 254. FIG. 13C illustrates two optional light diffusers, the first being a flat panel diffuser 139 and the second being an egg crate diffuser 239. In contrast to conventional egg crate type diffusers, which are located within the fixture structure above the ceiling level 258 and rely on collimating the light from the tubes 164 downward. The present egg crate diffuser 239 collimates the light but also reflects and partially transmits light on the panels depending on the material used. This results in the egg crate panels appearing to be illuminated but also shielding the bright LED tube.

Each light assembly 254 in the fixture 250 includes a reflector hood structure 160 received on the tray 252. The reflector structure 160 includes is designed with flanges 260 on both sides to properly position the module 254 to the desired height relative to the tray 252 and fasteners 262, e.g., threaded fasteners, clips, etc., are used to fasten the modules 254 to the tray 252. Although a two-module assembly is illustrated, it will be recognized that one to as many as four modules 254 may be incorporated into the mounting tray 252 with a minimum amount of modifications to the tray. Module design does not require additional modification. The junction box 170 is received between the upstanding sidewalls of the reflector hood 160. The electrical connection may be as described above for the previous modes described above. For example, the modules may be interconnected at the junction box 170, wherein the junction box is equipped with a power cord for connecting the assembly into an external power outlet of the building or structure or into an AC outlet 171 provided in the junction box of another, like fixture 254, e.g., adjacent to or ahead of it.

Figure 14:
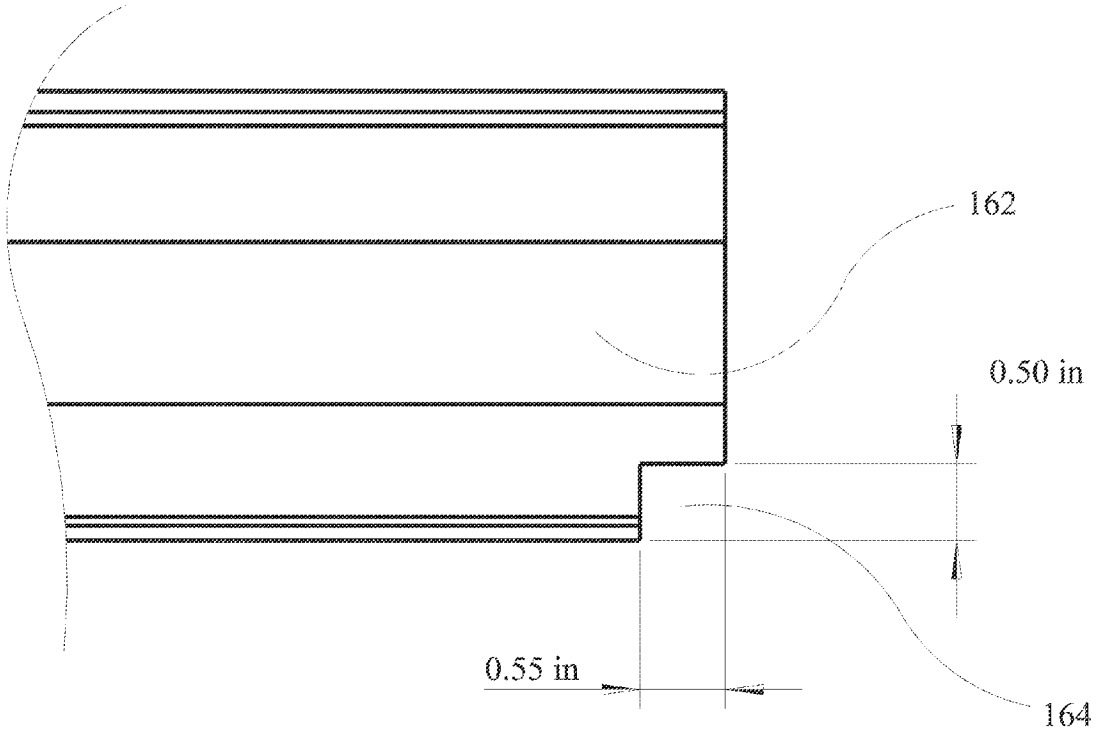

Except for the mounting tray 252, all other hardware used for the module 250 is the same as used for the modes previously outlined in this disclosure, except that the extruded reflector hood 162 of the LED reflector assembly 160 must be modified with notches 264 (see FIG. 14) in the lower corners in order to provide sufficient clearances for nominal 48-inch LED tubes 164 when the assembly 254 is mounted onto the tray 252.

One advantage of this modular fixture 250 over the conventional single integrated fixture is that the end user may modify the light distribution simply by changing the number of light modules 254 included on the mounting tray 252. Manufacturing is simplified whereas only one module design is produced regardless of the number of modules 254 configured onto a tray.

Figure 13D:
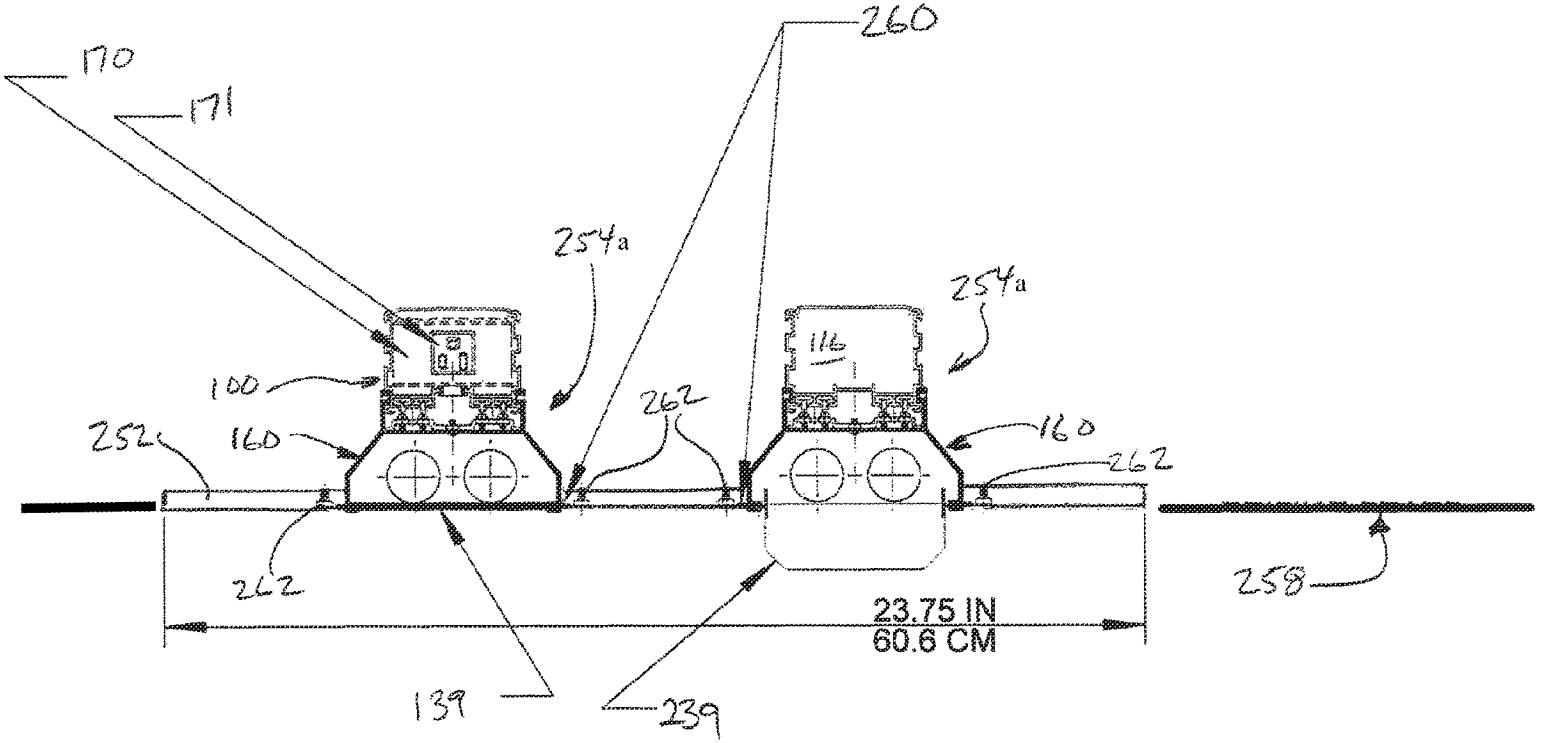
FIG. 13D illustrates an alternative embodiment adapted for use in connection with a suspended or drop ceiling system.

FIG. 13D shows a variation of the above ceiling grid embodiment, which is otherwise as described for FIGS. 13A-13C, except that lighting modules 254*a* employ the reflector assembly 160 mounted to a section of rail 100 as detailed above, wherein the channel 116 thereof may be used to receive the junction box 170 and wiring as detailed above.

Figure 15A:
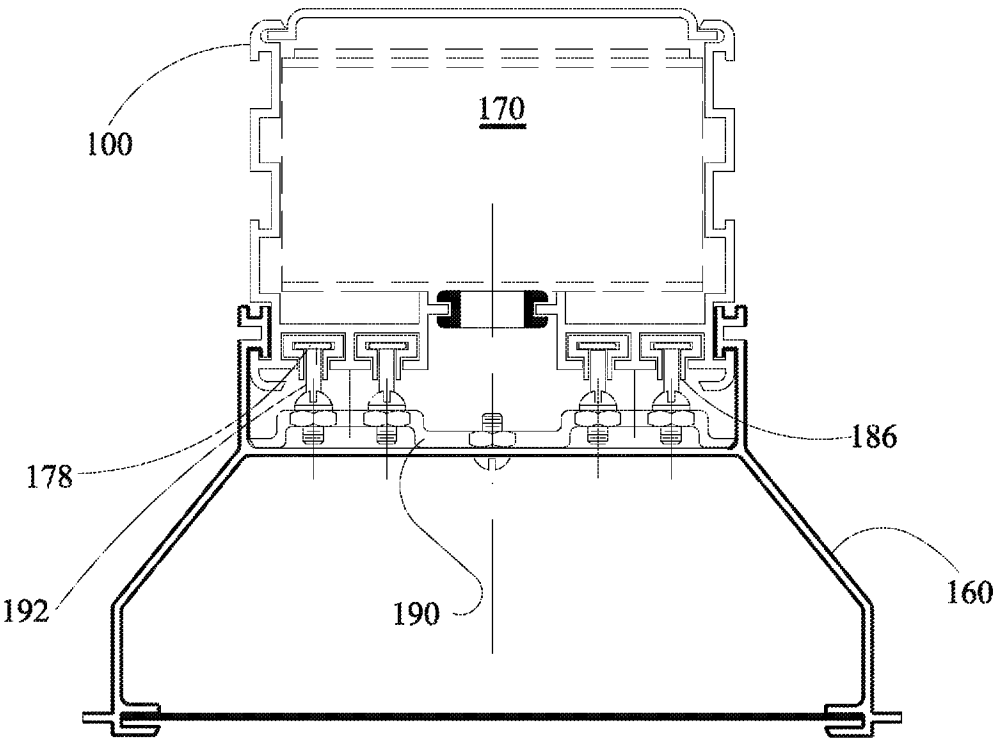
FIG. 15A is a cross-sectional view illustrating an exemplary method for electrically coupling power delivery rails to an electrical power supply.
Figure 16C:
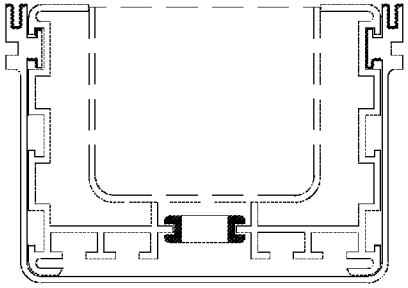
FIGS. 16A-16D are cross-sectional views of the main rail and connector sleeve in various configurations.
Figure 16D:
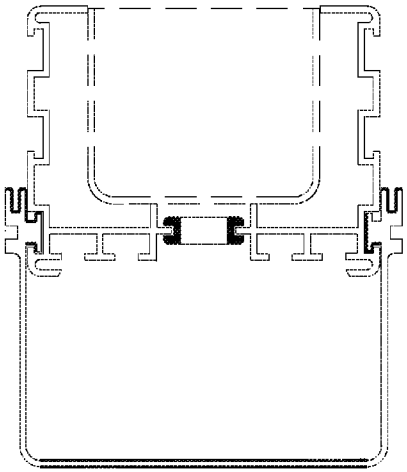
Figure 16A:
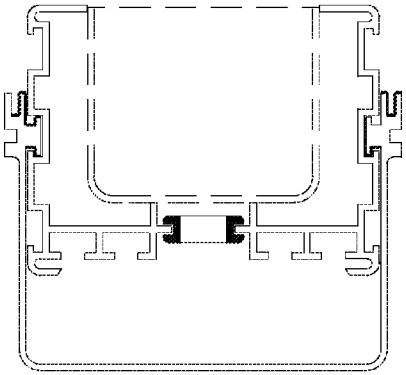
Figure 16B:
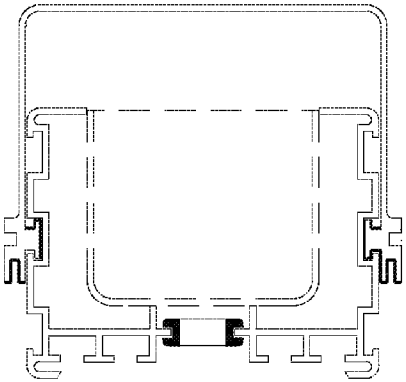

Referring now to FIGS. 15A-15D, there is now shown an exemplary method for delivering power using the slots 130*a*-130*d* formed in the lower surface of the main rail 100. The slots 130*a*-130*d* are available for transporting power to the LED tube fixtures or other devices mounted on the rail/track. A linear brush and flat conductor mechanism (linear version of slip rings) using the slots 130*a*-130*d* for this purpose is illustrated in FIGS. 15A-15B, which present an overview of the power transport mechanism where the slots 130*a*-130*d* used as guides or channels for flat wire conductors 178. Extruded insulator channels 186 having downward facing, axially-extending slots or openings are provided to isolate the flat wire 178 from the grounded aluminum rail structure 100.

As detailed above, the ends of the flat wire 178 are connected to insulated round wires 176 from the junction box 170 using terminal connectors 180 (see FIG. 5B). The round wires 176 are then fed into the junction box 170 where it is connected to the power input lead.

The block/brush assembly 190 shown in FIGS. 15B-15D is attached to the light fixture 160 that is mounted to the rail 100.

The brushes 192 are then connected to insulated wire leads 194 (see FIG. 5C) from the mounted devices with terminals. Sliding the LED fixture 160 onto the rail 100 results in brush 192 contacting the flat wire 178 through the axially-extending slots, thus completing the power feed to the LED assembly 160. A similar brush/block assembly may be employed to provide power to other mounted components such as those described in FIG. 6. One advantage to using this linear brush connector system in accordance with this preferred embodiment is that the light fixtures can be installed and removed at the site installation with no additional wiring being required. This is a considerable advantage in that it permits the fixtures to be assembled, factory wired, and shipped completely independently from the rail 100. Flexibility is also gained in that fixtures may be added or subtracted from the rail by simply sliding them on or off the rail for any lighting configuration modification.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A modular lighting system comprising:

a rigid, elongate rail member including a longitudinally-extending base member and first and second longitudinally-extending, upstanding sidewalls disposed on opposite transverse sides of the base member, the base member and the first and second sidewalls cooperating to define a longitudinally-extending main channel;

said base member having an inward-facing surface and an outward-facing surface, and further including a plurality of longitudinally-extending base channels formed on the outward facing surface thereof;

each of said first and second sidewalls having an inward-facing surface and an outward-facing surface, each of said first and second sidewalls further including one or more longitudinally-extending side channels formed on the outward facing surface thereof;

a connector sleeve having a proximal end and a distal end opposite the proximal end, the proximal end receiving and fastened to an end of said rail member, the connector sleeve having an interior shape and dimension substantially similar to said rail member, the distal end for receiving and fastening to an end of a like rail member;

a connector fitting comprising a first segment attached to one or more second segments, the first segment having a cross-sectional shape and dimension substantially the same as the rail member and adapted to be received in and fastened to the distal end of said connector sleeve; and each of the one or more second segments having an interior shape and dimension substantially similar to said rail member, the one or more second segments for receiving and fastening to an end of a like rail member.

2. The lighting system of claim 1, further comprising:

one or more lighting assemblies coupled to said rail member.

3. The lighting system of claim 2, further comprising:

one or more circuit elements for electrically coupling said one or more lighting assemblies to an external power source received in said main channel.

4. The lighting system of claim 2, further comprising:

wherein said one or more circuit elements includes an electrical junction box having a first electrical connector for electrical connection to an external power source and a second electrical connector for plugging in an additional electrical device.

5. The lighting system of claim 4, wherein said additional electrical device is selected from another light fixture and an electromechanical device.

6. The lighting system of claim 1, further comprising:

one or more lighting assemblies received within said base channels; and a power supply electrically received within said main channel and coupled to said one or more lighting assemblies.

7. The lighting system of claim 6, further comprising:

said one or more lighting assemblies including one or more flexible LED strips; and optionally, a diffuser mounted to the rail member adjacent the one or more flexible LED strips.

8. The lighting system of claim 1, further comprising:

an elongate reflector hood including a first and second longitudinally-extending attachment arms removably attached to a respective one of said one or more longitudinally-extending side channels on the rail member;

said reflector hood including a first panel extending between said attachment arms, said first panel having one or more sockets mounted thereto, said one or more sockets for attaching one or more lighting elements; and said reflector hood further including longitudinally-extending reflector surfaces extending along opposite transverse sides of said first panel.

9. The lighting system of claim 8, further comprising:

an electrical junction box received in said main channel and having a first electrical connector for electrical connection to an external power source;

electrical conductors electrically coupling said one or more sockets to said junction box, said electrical conductors running in one or both of (1) said main channel and (2) one or more of said plurality of longitudinally-extending base channels; and optionally, a second electrical connector for plugging in an additional electrical device.

10. The lighting system of claim 8, further comprising:

a second panel removably attached to the rail member and extending between the first and second sidewalls, the second panel facing and spaced apart from the base member and extending parallel to the base member.

11. The lighting system of claim 10, further comprising:

one or more channels formed on an outward facing surface of the second panel; and a flexible LED strip removably received within each of said one or more channels.

12. The lighting system of claim 1, further comprising:

a first longitudinally-extending electrical conductor received in a first one of said base channels and a second longitudinally-extending electrical conductor received in a second one of said base channels;

said first and second electrical conductors received within respective first and second electrically-insulating sleeves, said first insulating sleeve having a first longitudinally-extending slit which is aligned with an opening in the first one of said base channels and said second insulating sleeve having a second longitudinally-extending slit which is aligned with an opening in the second one of said base channels.

13. The lighting system of claim 12, further comprising:

an electrical device including a mechanical fastener adapted to be attached to the rail member;

first and second electrical contacts on the mechanical fastener in electrical communication with the electrical device;

said first electrical contact extending through said first slit and said second electrical contact extending through said second slit when the mechanical fastener is attached to the rail member, said first and second electrical contacts configured to make electrical contact with a respective one of the first and second electrical conductors when the electrical device is attached at any of a plurality of axial positions along the rail member.

14. The lighting system of claim 1, further comprising:

one or more mechanical fasteners for suspending the lighting system from overhead structure.

15. The lighting system of claim 14, further comprising:

a mounting sleeve having an interior shape and dimension substantially similar to said rail member, the mounting sleeve including a first and second longitudinally-extending attachment arms slidably attached to a respective one of said one or more longitudinally-extending side channels on the rail member;

said mounting sleeve including a transverse panel extending between said attachment arms and a pivot member pivotally attaching a fastener to the transverse panel, said fastener pivotal about a pivot axis orthogonal to the transverse panel whereby the fastener can be secured to an overhead structure at a plurality at a plurality of angular orientations relative to the rail member.

16. The lighting system of claim 1, further comprising:

said connector sleeve including an upper panel and first and second side panels adjacent said first and second sidewalls, respectively;

each of said first and second side panels having an inward facing longitudinally-extending protrusion engaging one of said one or more side channels on a respective one of said first and second sidewalls.

17. The lighting system of claim 1, wherein said connector fitting is selected from an angled connector and a branched connector.

18. The lighting system of claim 1, wherein one or more of said connector sleeve, said connector fitting, and said rail member is formed by extrusion.

19. The lighting system of claim 1, further comprising a quick release pin removably securing the connector sleeve to the rail member.

20. The lightning system of claim 1, further comprising one or more flexible LED strips received within said base channels, each of said one or more flexible LED strips comprising a flexible encapsulated circuit board having a plurality of LED elements spaced along its length.

* * * * *